US005975627A

United States Patent [19]

LaPointe et al.

[11] Patent Number: 5,975,627

[45] **Date of Patent: *Nov. 2, 1999**

[54] SWIVEL BASE RECLINING CHAIR WITH LINKAGE RECLINING MECHANISM

[75] Inventors: Larry P. LaPointe, Temperance; Karl J. Komorowski, Petersburg, both of Mich.

[73] Assignee: La-Z-Boy Incorporated, Monroe, Mich.

[ * ] Notice: This patent is subject to a terminal disclaimer.

[21] Appl. No.: 09/062,634

[22] Filed: Apr. 17, 1998

Related U.S. Application Data

[63] Continuation-in-part of application No. 08/855,031, May 13, 1997.

[51] Int. Cl.[6] ..... A47C 1/02

[52] U.S. Cl. ..... 297/68; 297/83; 297/85

[58] Field of Search ..... 297/68, 83, 85

[56] References Cited

U.S. PATENT DOCUMENTS

| | | | |
|---|---|---|---|
| Re. 34,666 | 7/1994 | Tacker | 297/85 |
| 3,758,151 | 9/1973 | Re | 297/83 |
| 4,071,275 | 1/1978 | Rogers, Jr. | 297/85 |
| 4,099,776 | 7/1978 | Crum et al. | 297/68 X |
| 4,108,491 | 8/1978 | Rogers, Jr. | 297/85 |
| 4,131,960 | 1/1979 | Quakenbush . | |
| 4,185,869 | 1/1980 | Rogers, Jr. | 297/68 X |
| 4,188,062 | 2/1980 | Rogers, Jr. et al. | 297/85 |
| 4,216,991 | 8/1980 | Holobaugh | 297/85 |
| 4,226,469 | 10/1980 | Rogers, Jr. et al. | 297/85 |
| 4,244,620 | 1/1981 | Harrison et al. | 297/85 |
| 4,249,772 | 2/1981 | Rogers, Jr. | 297/85 |
| 4,291,913 | 9/1981 | Kowalski | 297/68 X |
| 4,306,746 | 12/1981 | Crum | 297/85 |
| 4,307,912 | 12/1981 | Watt et al. | 297/85 |
| 4,337,977 | 7/1982 | Rogers, Jr. et al. | 297/85 |
| 4,350,386 | 9/1982 | Rogers, Jr. | 297/85 |
| 4,350,387 | 9/1982 | Rogers, Jr. | 297/85 |
| 4,367,895 | 1/1983 | Pacitti et al. | 297/85 |
| 4,418,957 | 12/1983 | Rogers, Jr. | 297/85 |
| 4,531,778 | 7/1985 | Rogers, Jr. | 297/85 |
| 4,570,995 | 2/1986 | Rogers, Jr. | 297/68 |
| 4,577,902 | 3/1986 | Crum | 297/85 |
| 4,740,031 | 4/1988 | Rogers, Jr. | 297/85 |
| 4,805,960 | 2/1989 | Tacker | 297/85 |
| 4,815,788 | 3/1989 | May | 297/68 |
| 4,826,243 | 5/1989 | Lawson | 297/85 |
| 4,863,215 | 9/1989 | Crum | 297/85 |
| 4,878,710 | 11/1989 | Tacker | 297/68 |
| 4,989,914 | 2/1991 | Pine | 297/85 |
| 5,011,220 | 4/1991 | LaPointe | 297/84 X |
| 5,064,244 | 11/1991 | Sproule | 297/68 |
| 5,072,988 | 12/1991 | Plunk | 297/68 |
| 5,129,701 | 7/1992 | Pine | 297/68 |
| 5,217,276 | 6/1993 | LaPointe et al. | 297/85 |

(List continued on next page.)

*Primary Examiner*—Peter M. Cuomo
*Assistant Examiner*—Rodney B. White
*Attorney, Agent, or Firm*—Harness, Dickey & Pierce, P.L.C.

[57] ABSTRACT

A reclining chair is provided which includes a base frame, a support linkage assembly pivotally supported from the base frame, a seat back operably coupled to the support linkage and a chair frame, including a seat frame, secured to the support linkage. A longitudinal link is operably interconnected to the support linkage assembly. A recline linkage assembly is operably coupled to the longitudinal link and to the base for controlling movement of the longitudinal link from an upright position to at least one reclined position. A rotatable drive shaft is journally supported by the longitudinal link. The reclining chair further includes a leg rest assembly supported from the longitudinal link and operably coupled to the drive shaft for movement from a retracted position to an extended position in response to rotation of the drive shaft. The support linkage further operates to recline the seat assembly between an upright position and a fully reclined position. The reclining chair optionally incudes a swivel base which provides a rotational degree of freedom between the chair frame and the floor.

42 Claims, 13 Drawing Sheets

U.S. PATENT DOCUMENTS 5,292,170 3/1994 LaPointe et al. ..... 297/85
5,323,526 6/1994 Saul et al. ..... 297/83 X
5,360,255 11/1994 Cook et al. ..... 297/68 X
5,382,073 1/1995 Habegger et al. ..... 294/85
5,423,591 6/1995 LaPointe et al. ..... 294/85 X
5,435,621 7/1995 Komorowski et al. ..... 297/85 X
5,480,209 1/1996 May ..... 297/85
5,480,213 1/1996 Sproule ..... 297/85 X
5,527,092 6/1996 Cook et al. ..... 297/68 X
5,527,095 6/1996 Marshall et al. ..... 297/85 X
5,556,158 9/1996 Wiecek ..... 297/85
5,570,927 11/1996 LaPointe et al. ..... 297/85
5,570,930 11/1996 LaPointe et al. ..... 297/85 X
5,588,710 12/1996 Wiecek ..... 297/85 X

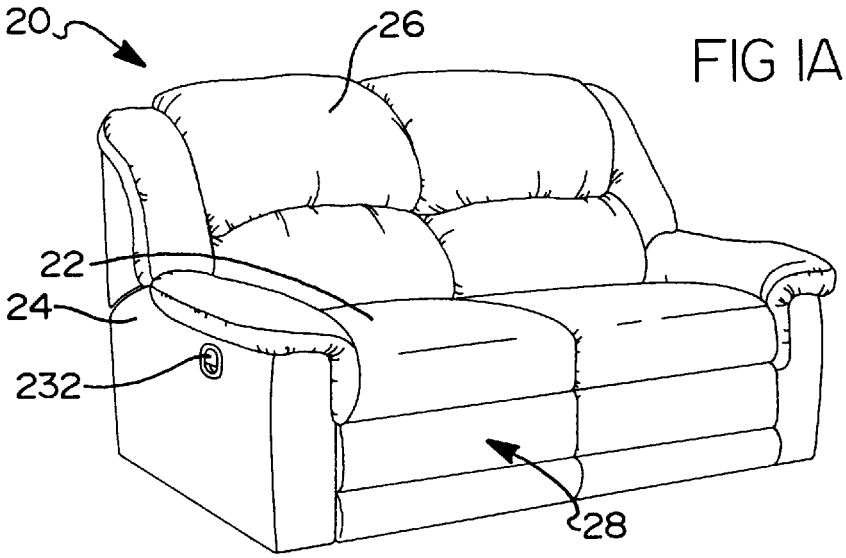
FIG IA
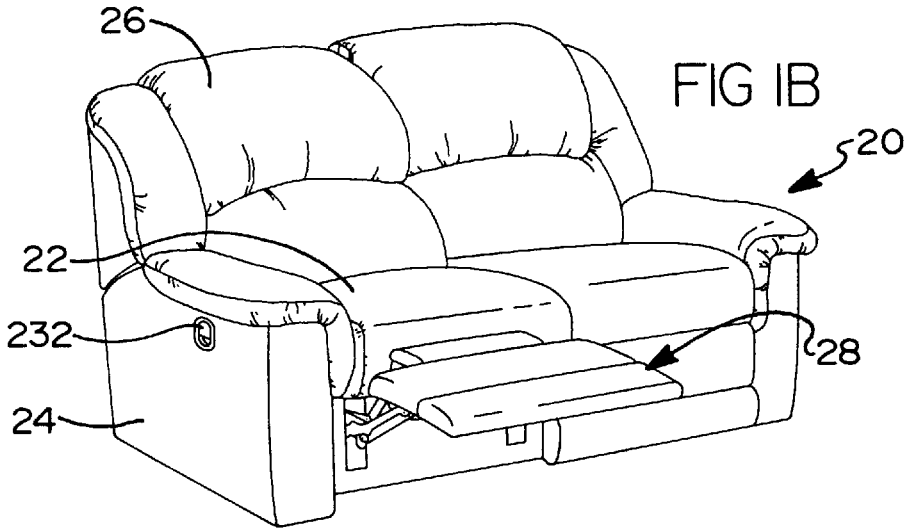
FIG IB
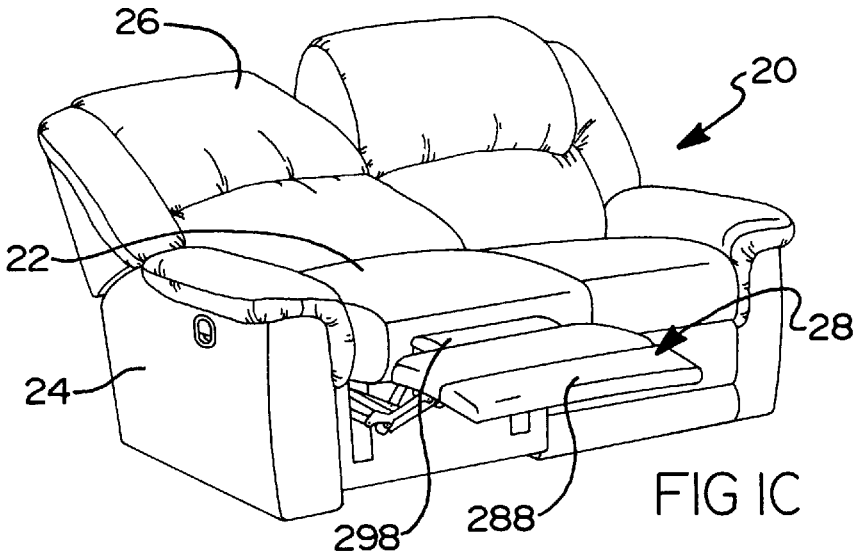
FIG IC

FIG 10
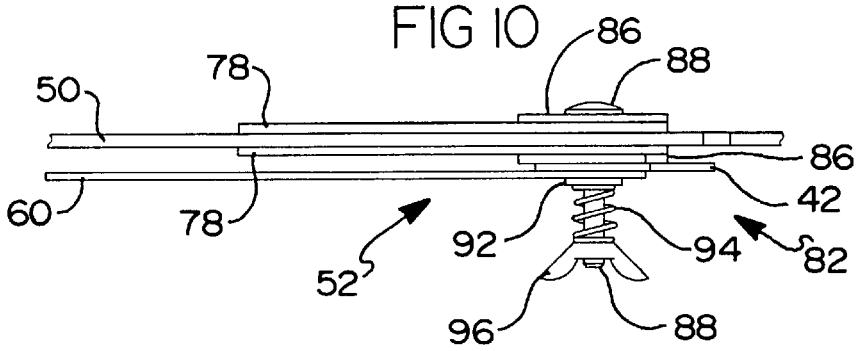
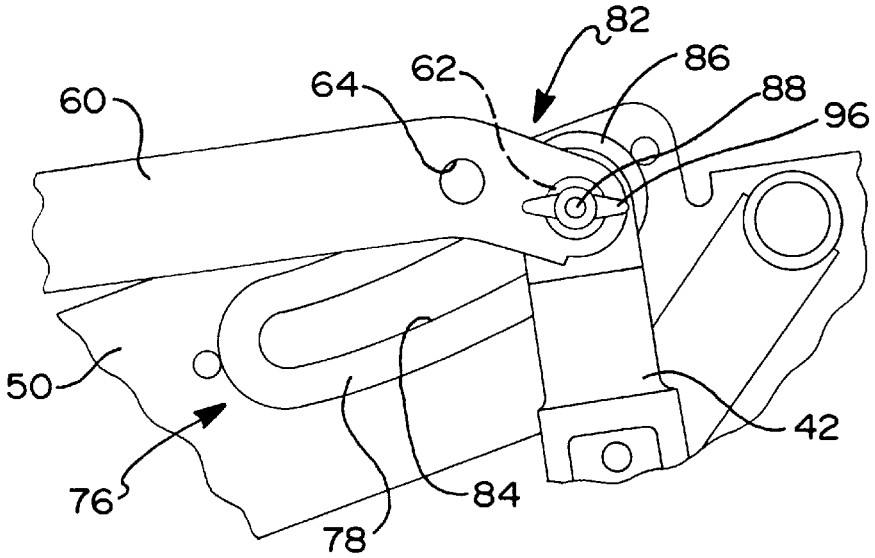
FIG 11
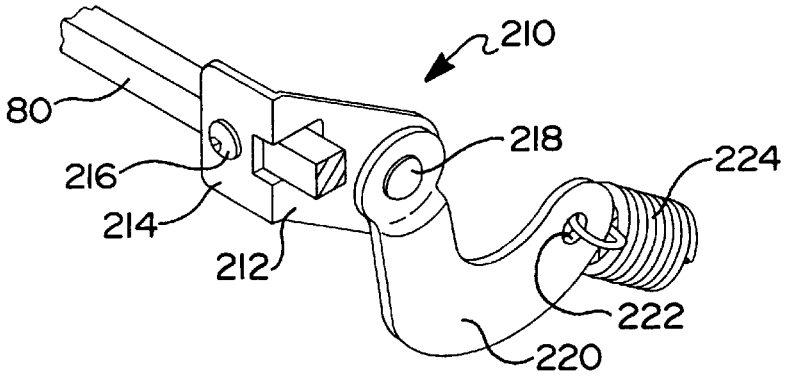
FIG 9

FIG 12A
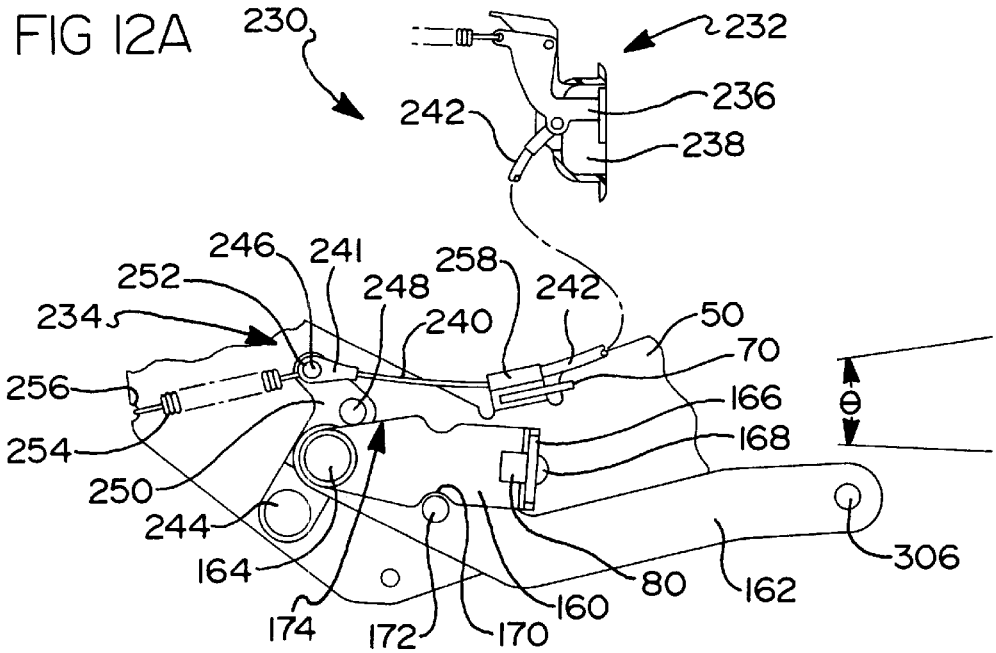
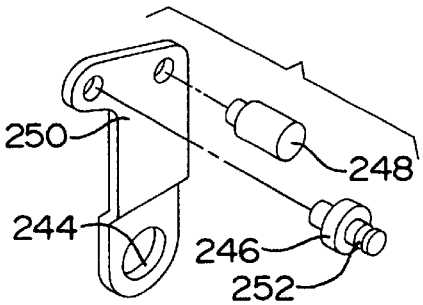
FIG 12C
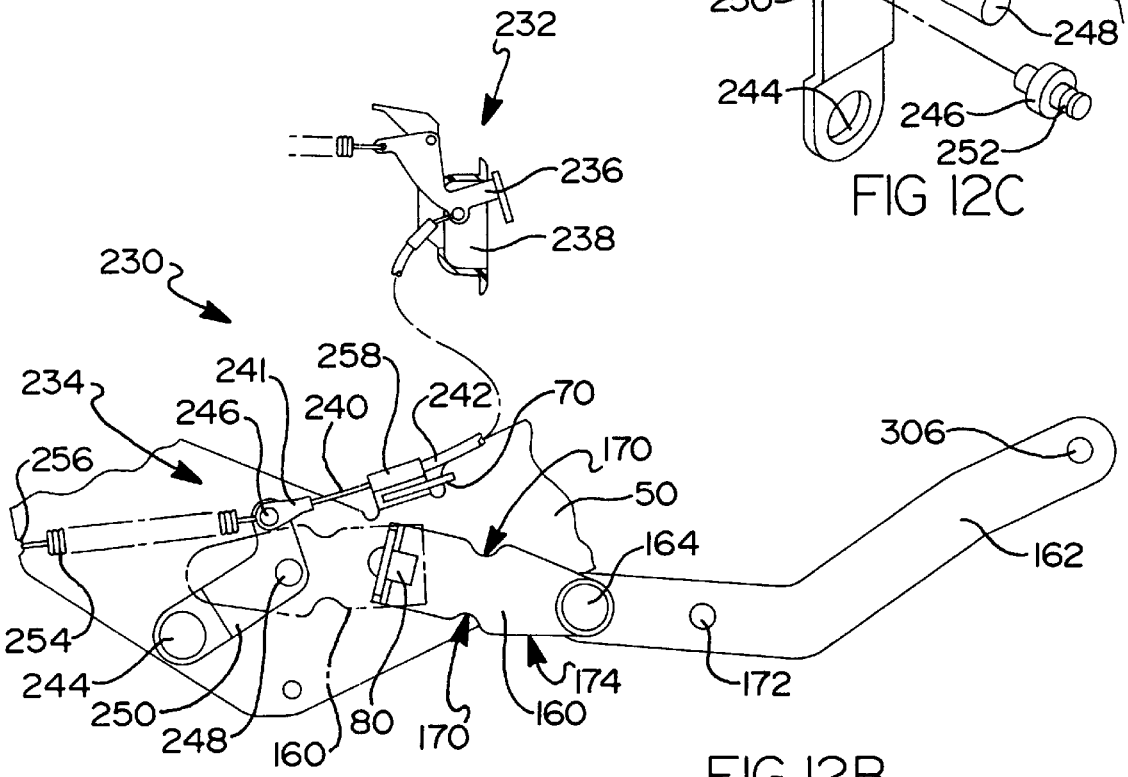
FIG 12B

SWIVEL BASE RECLINING CHAIR WITH LINKAGE RECLINING MECHANISM

CROSS-REFERENCE TO RELATED APPLICATION

This is a continuation-in-part of U.S. application Ser. No. 08/855,031 filed May 13, 1997.

BACKGROUND OF THE INVENTION

The present invention relates generally to a reclining chair and, more specifically to a reclining chair having a compact modular chair frame supported on a swivel base and an all-linkage reclining mechanism.

Reclining chairs are known within the art, and are becoming increasingly popular as it becomes more desirable to integrate comfort and reclining functions into various articles and styles of furniture including chairs, love seats and sofas. Many of the first developed designs were based upon all-linkage mechanisms. However, these all-linkage mechanisms typically did not provide a smooth reclining motion and were extremely large. As such the articles of furniture which utilized this mechanism were oversized. Moreover, these chairs required a large amount of free space to enable operation thereof. The all-linkage reclining chair mechanisms known within the art also did not provide adequate adjustment features for accommodating seat occupants of varying stature.

To overcome this problem, alternate reclining mechanisms were developed such as wall proximity reclining mechanisms utilizing track and roller assemblies which provided a smoother reclining motion. Presently, the reclining mechanisms utilizing track and rollers are fairly complex, require numerous components of varying types such as links, tracks and rollers, and are thus relatively expensive to manufacture. An exemplary reclining chair mechanism which was developed to provide a smoother reclining motion is that disclosed in U.S. Pat. No. 5,011,220, entitled "Chair Mechanism," which is commonly owned by the assignee of the present invention and the disclosure of which is expressly incorporated herein by reference. This mechanism utilizes a short inclined track and roller to provide the recline-away motion of the wall proximity reclining chair. While this chair mechanism achieved the goal of providing smoother reclining operation, the design of this mechanism presents several disadvantages. First, this mechanism is limited to only two operative positions, namely the upright position, and the fully-reclined position. Additionally, this chair design does not allow the chair arms to move along with the seat assembly. Thus, this chair design requires a chair frame having more forwardly extending arm rests for providing adequate support when the chair mechanism is in the fully reclined position.

Another exemplary wall proximity reclining chair is that disclosed in U.S. Pat. No. 5,217,276, entitled "Chair Mechanism," and which is commonly owned by the assignee of the present invention and the disclosure of which is expressly incorporated herein by reference. This chair mechanism design provides several improvements over those mechanisms known within the art. However, this mechanism also relies upon a track and roller system for providing smooth reclining motion. Additionally, this chair is also limited to only two reclining positions, and requires manual actuation via a hand operated lever. Accordingly, this design limits the types of furniture within which this mechanism can be integrated.

Yet another type of wall proximity reclining chair is that illustrated in U.S. Pat. No. 5,323,526, entitled "Method for Assembling A Modular Wall Proximity Reclining Chair," which is commonly owned by the assignee of the present invention and the disclosure of which is expressly incorporated herein by reference. This chair was developed for reducing the complexity of the reclining mechanism, and its method of assembly. This chair mechanism overcomes the disadvantages of the prior art designs by providing a side frame and arm rest assembly that moves in conjunction with the seat assembly for providing adequate arm rest support. However, this mechanism design also relies upon a full length track and roller assembly for providing the desired smoothness in the reclining operation. The requirement for a bearing-based roller assembly also increases the cost of the mechanism. Additionally, the design of this mechanism limits this chair to a single reclining chair and further prevents this mechanism from being used in larger articles of furniture, such as love seats, sofas and modular sofa assemblies.

In view of the growing popularity of reclining chairs and the increasing desire to use reclining chairs in a more formal setting, there is a increasing need to develop a reclining chair mechanism which can be utilized with various types of furniture, including compact reclining chairs, at a considerably lower cost and that provides the comfort features demanded by consumers. As such, it is desirable to provide an all-linkage reclining chair which delivers smooth reclining motion, which includes an adjustment feature for accommodating various sized seat occupants, and which is readily assembled into various sizes and styles of chairs. It is also desirable to provide an all-linkage reclining chair mechanism which is designed to be primarily gravity driven with the assistance of a spring biasing mechanism, rather than manually driven through the use of an externally mounted operating handle. Such a design would simplify the operation of the chair. It is further desirable to provide a reclining chair mechanism in which the leg rest assembly can be fully extended by actuating a compact trigger release assembly, and can be retracted by the occupant merely moving the leg rest assembly back into the chair mechanism by leaning forward and placing a small amount of force onto the leg rest assembly. It is also desirable to provide a reclining mechanism in which the leg rest assembly can be replaced in the field, if damaged during use, without disassembling the entire chair and its associated reclining mechanism. It is further desirable to provide an all-linkage reclining mechanism which moves the associated chair frame forwardly as the seat assembly is reclined, thereby allowing for uninhibited operation when the chair is placed in close proximity to a wall.

SUMMARY OF THE INVENTION

In accordance with the principles of the present invention, an reclining chair having a compact chair frame supported on a swivel base and an all-linkage reclining mechanism is disclosed. The reclining chair includes a chair frame operably coupled to a base frame via a support linkage assembly. A swivel base assembly is secured to the base frame to provide a rotational degree of freedom between the floor and the base frame. A longitudinal link is operably interconnected to the support linkage assembly. A recline linkage assembly is operably coupled between the longitudinal link and to the base frame for controlling movement of the longitudinal link from an upright position to at least one reclined position. A rotatable drive shaft is journally supported by the longitudinal link. The reclining chair further includes a leg rest assembly supported from the longitudinal link and operably coupled to the drive shaft for movement from a retracted position to an extended position in response to rotation of the drive shaft.

Accordingly, a principle object of the invention is to provide a compact, smoothly operating all-linkage reclining mechanism which can be incorporated into reclining chairs of varying sizes and styles.

It is another object of the present invention to provide a primary linkage reclining mechanism which is positioned under the seat, within the seat tabs, to appropriately position the various pivots of the reclining mechanism in correspondence with various biomechanical points associated with the seated occupant, thereby enhancing the comfort of the reclining mechanism.

It is a further object of the present invention to provide an all-linkage reclining mechanism which is readily adjustable to optimize the force required to initiate and continue the reclining movement, as well as to retract the leg rest assembly from the fully extended position.

It is an additional object of the present invention to provide a reclining mechanism which supports the chair frame in an extremely stable condition irrespective of its orientation in the upright, partially reclined or fully reclined position.

These and other additional objects, advantages and features of the present invention will become apparent from the following description and appended claims, taken in conjunction with the accompanying drawings.

DESCRIPTION OF THE DRAWINGS

FIGS. 1A through 1C are perspective views of an exemplary wall proximity reclining chair showing the various operative positions, including an upright position with the leg rest assembly retracted, a partially reclined position with the leg rest assembly fully extended, and a fully reclined position with the leg rest assembly extended and the seat back fully reclined;

FIG. 9 is a perspective view showing the spring assist drive linkage in accordance with a preferred embodiment of the present invention;

FIG. 10 is a top view of the adjustable seat slide mechanism in accordance with a preferred embodiment of the present invention;

FIG. 11 is a partial side elevational view of the adjustable seat slide mechanism, also in accordance with a preferred embodiment of the present invention;

FIG. 12A is a side view of the cable release assembly in the retracted or locked position, in accordance with a preferred embodiment of the present invention;

FIG. 12B is a side view of the cable release assembly in the fully released position, also in accordance with a preferred embodiment of the present invention;

FIG. 12C is an exploded perspective view of the trip link assembly in accordance with the present invention;

DETAILED DESCRIPTION OF THE INVENTION

Figure 2:
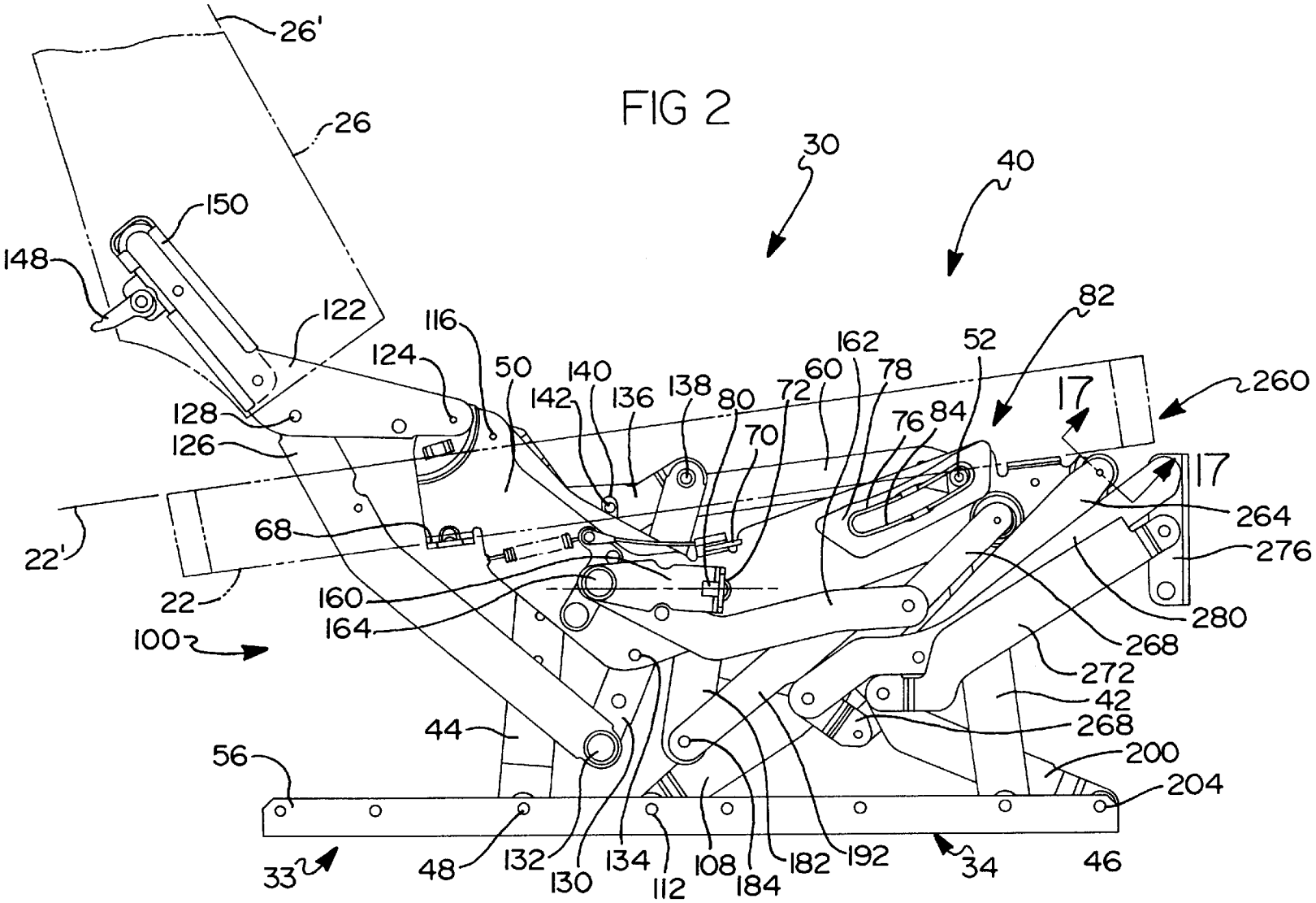
FIG. 2 is an outside elevational view of an all-linkage assembly in accordance with a preferred embodiment of the present invention with the upholstery, springs and other parts removed from the reclining mechanism for illustrating the integrated and interdependent association of the linkage components.

In accordance with the teachings of the present invention, an all-linkage reclining chair adapted for use in various articles of motion furniture is disclosed. In a first preferred embodiment, a pair of all-linkage mechanisms are integrated into a love seat in which each side defines a wall proximity reclining chair which independently reclines. In a second preferred embodiment, a pair of all-linkage mechanisms are integrated into a compact reclining chair having a swivel base operably associated therewith. While disclosed with reference to particular embodiments, it should be understood that the present invention can be incorporated into a variety of motion furniture designs. With particular reference now to the drawings, the structural and functional aspects of the present invention are described with more particular detail.

With reference now to FIGS. 1A through 1C, wall proximity reclining chair 20 includes a seat frame 22 having an arm rest or side frame 24, and further includes a reclinable seat back 26 and movable leg rest assembly 28. FIG. 1A illustrates wall proximity reclining chair 20 in its upright position, with leg rest assembly 28 retracted within the chair. FIG. 1B illustrates the wall proximity reclining chair 20 in its partially reclined or intermediate position, in which leg rest assembly 28 is fully extended and seat back 26 is partially reclined. Leg rest assembly 28 is positionable between a retracted position shown in FIG. 1A and an extended position as shown in FIGS. 1B and 1C. FIG. 1B further illustrates the wall proximity feature in that seat frame 22, side frame 24, and seat back 26 move forwardly along with leg rest assembly 28 when the wall proximity reclining chair 20 is moved from its upright position to its partially reclined position. Finally, FIG. 1C illustrates wall proximity reclining chair 20 in its fully reclined position. It should be noted that leg rest assembly 28 must be fully extended before seat back 26 can begin reclining. As will be appreciated from FIG. 1C, and the following detailed description, when wall proximity reclining chair 20 is in the partially reclined position, additional rearward pressure placed against seat back 26 by the occupant, correspondingly forces the seat frame 22, side frame 24 and leg rest assembly 28 forward. Accordingly, the all-linkage mechanism is designed to allow seat back 26 to be placed within approximately 5–6 inches (12–15 cm) of a wall surface and achieve a fully reclined position without seat back 26 making contact with the proximal wall surface.

Figure 3:
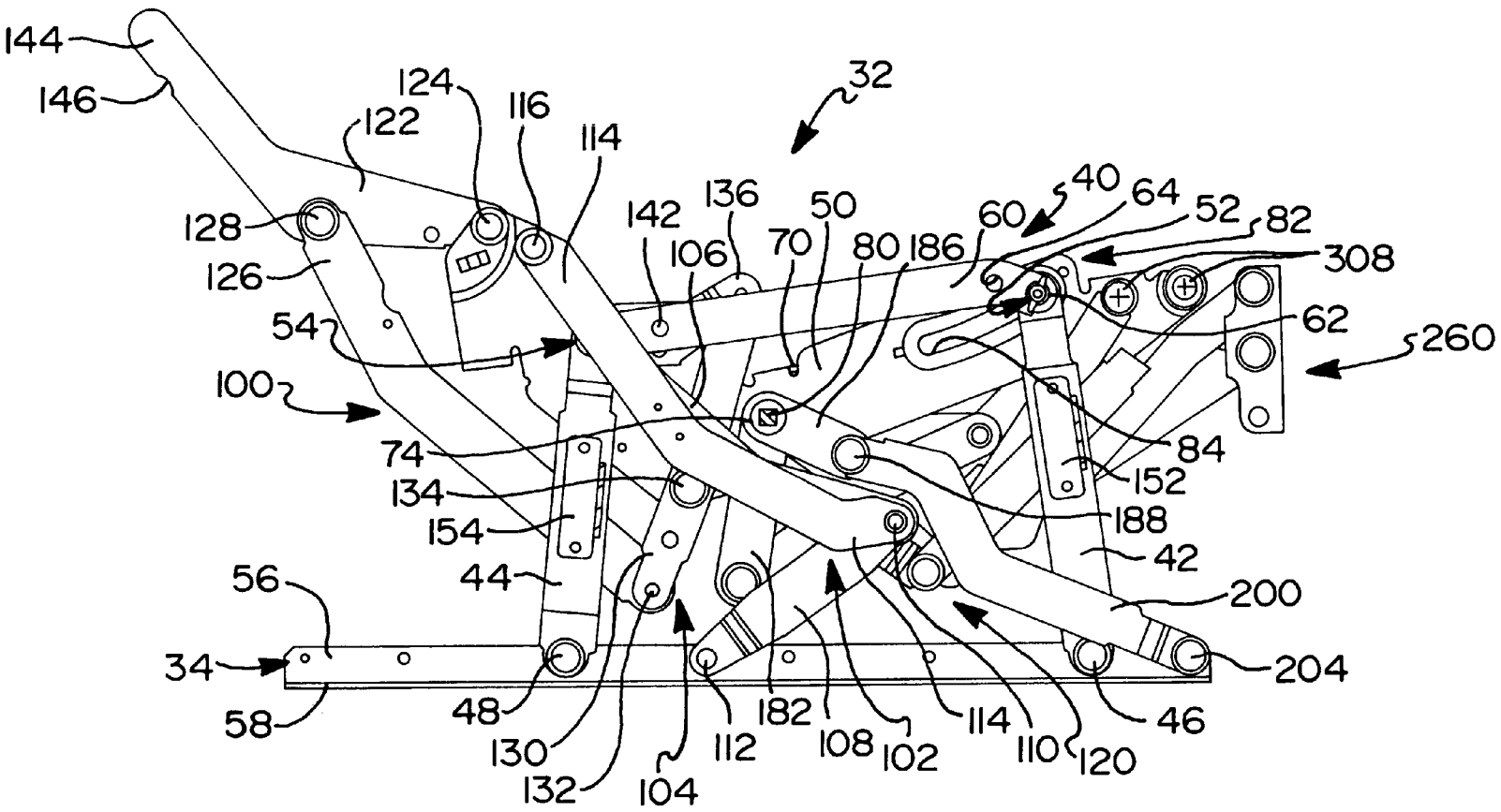
FIG. 3 is an inside elevational view of the all-linkage mechanism shown in the upright position in accordance with a preferred embodiment of the present invention.
Figure 4:
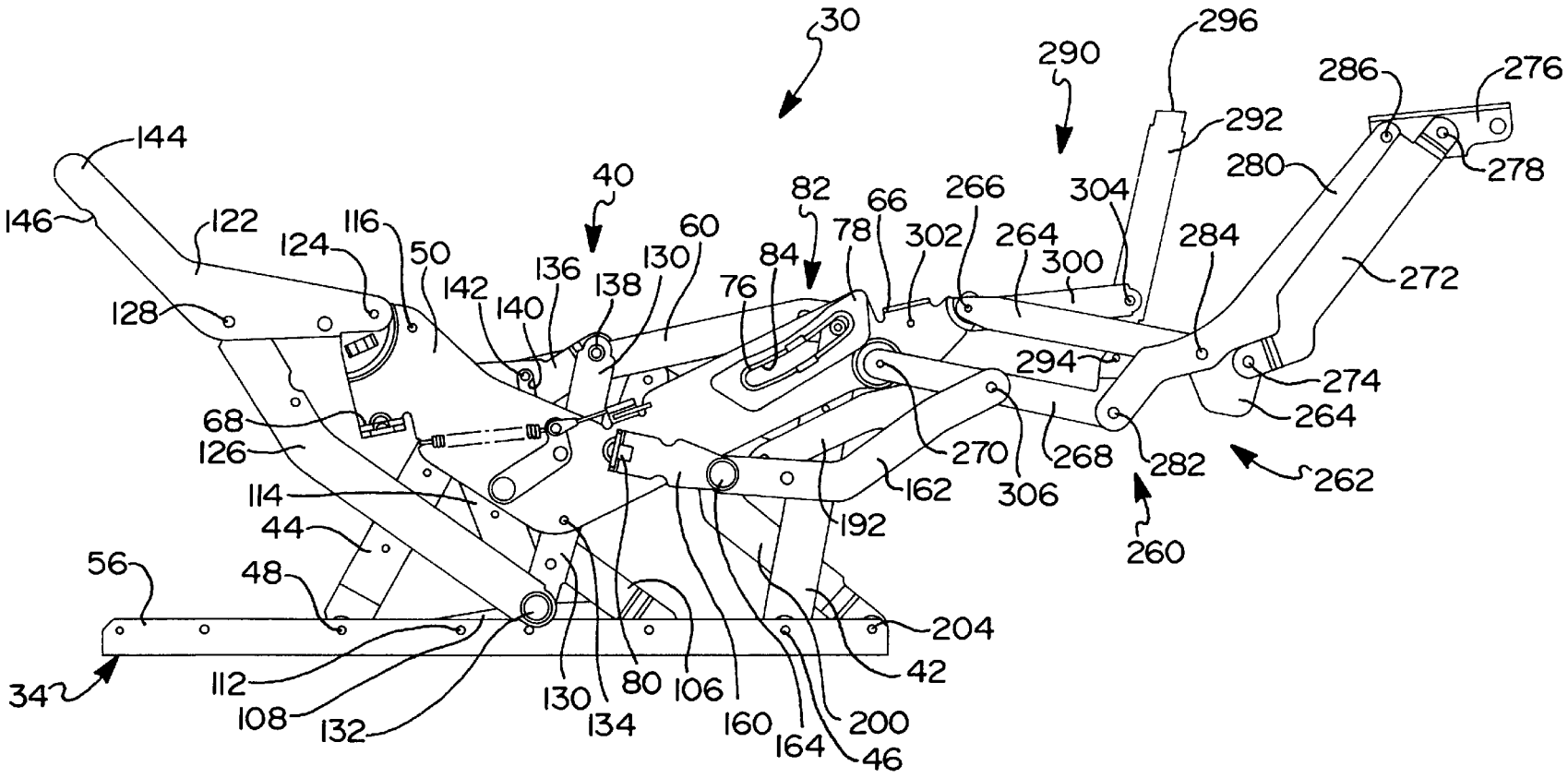
FIG. 4 is an outside elevational view of the all-linkage mechanism in the partially reclined position in accordance with a preferred embodiment of the present invention.

Referring now to FIGS. 2 through 7, a preferred embodiment of the present invention is illustrated in more detail. With particular reference to FIGS. 2 and 3, wall proximity reclining chair 20 includes right and left all-linkage mechanisms 30, 32. FIG. 2 is an outside view of the right all-linkage mechanism 30 in the upright position, and FIG. 3 is an inside view of the left all-linkage mechanism 32 in the same position. After viewing FIGS. 2 through 7, it can be understood that the all-linkage mechanisms 30, 32 are mirror images of each other. All-linkage mechanism 30, 32 are operably coupled to base frame 33. More specifically, each all-linkage mechanism 30, 32 is pivotably secured to a longitudinal "L-shaped" base rail 34. Referring briefly to FIG. 8, the pair of longitudinal base rails 34 are then secured to front and rear "L-shaped" frame rails 36, 38. Each front and rear frame rail 36, 38 has a series of three hole formations 37 bored therein. The three holes 37 allow the spacing between two adjacent reclining chairs 20 to be selected for accommodating various styles of chairs which may have different thicknesses of padding and upholstery. The series of three hole formations 37 also allow a greater degree of precision and rigidity over a conventional slot and fastener.

With continued reference to FIG. 8, a pair of corner brackets 39 are secured between each longitudinal base rail 34 and the rear frame rail 38. The forward end of each corner bracket 39 is offset by 45° so that it can be secured to the horizontal flange 58 of the longitudinal base rail 34 in two places with suitable fasteners. The opposite end of each corner bracket 39 is also secured to the rear frame rail 38 with suitable fasteners. In view of this interconnection scheme between the longitudinal base rails 34, the rear frame rail 38, and the corner brackets 39, one skilled in the art will readily appreciate the enhanced rigidity provided by securing corner brackets 39 with three fasteners as shown. Additionally, this interconnection scheme provides the precise alignment required by each all-linkage mechanism 30, 32 with respect to the other. Thus, base frame 33 is a rigid, generally rectangular support frame defined by the pair of longitudinal base rails 34, front and rear frame rails 36, 38, and corner brackets 39. As disclosed, the front and rear frame rails 36, 38 can be sized to a variety of lengths such that wall proximity reclining chair 20 can embody a single reclining chair, or integrated within a love seat or sofa. Additionally, reclining chair 20 and the all-linkage mechanisms 30, 32 are suitable for use in a modular sofa assembly.

Figure 5:
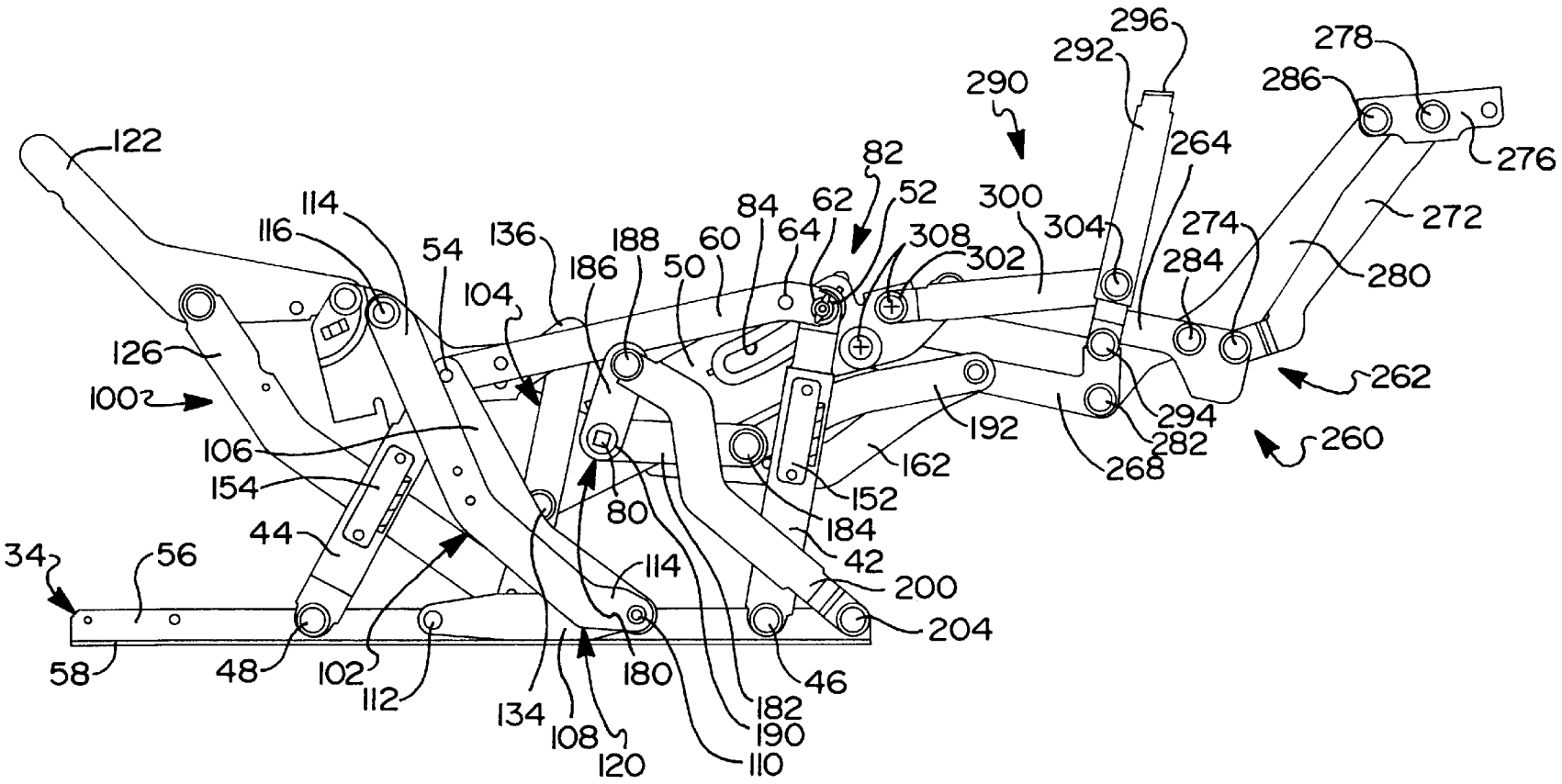
FIG. 5 is an inside elevational view of the all-linkage mechanism in the partially reclined position in accordance with a preferred embodiment of the present invention.
Figure 6:
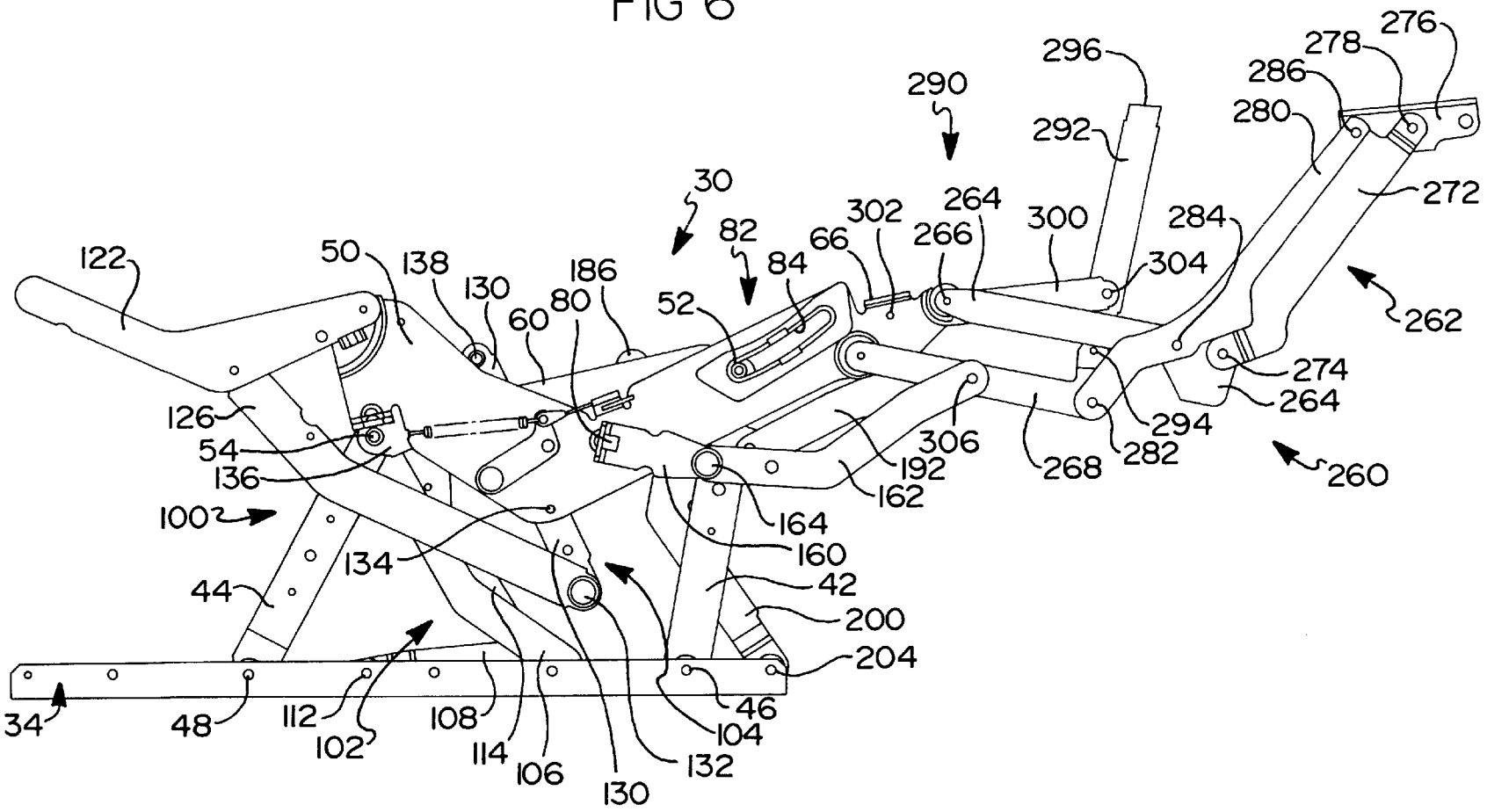
FIG. 6 is an outside elevational view of the all-linkage mechanism shown in the fully reclined position.

Referring now to FIGS. 2 through 8, the individual components forming each all-linkage mechanism are described in more detail. Each all-linkage mechanism 30, 32 is generally supported from its longitudinal base rail 34 by a four-bar linkage assembly 40. More specifically, the four-bar linkage assembly 40 includes a front support link 42 and a rear support link 44 which are pivotably coupled at their lower ends to the vertical flange 56 of the longitudinal base rail 34 and pivotably coupled at their upper ends to an intermediate link 60. The front support link 42 is connected to the base rail 34 at pivot 46 and the rear support link 44 is connected to the base rail 34 at pivot 48. Additionally, the front support link 42 is pivotably coupled to intermediate or secondary longitudinal link 60 at pivot 52 and the rear support link 44 is pivotably coupled to the intermediate or secondary longitudinal link 60 at pivot 54 (FIG. 5). Intermediate or secondary longitudinal link 60 includes two forward apertures 62, 64 for selectively adjusting the pivotal connection 52 with front support link 42. The right and left all-linkage mechanisms are interconnected to each other by a front cross member 152 which connects between the front support links 42, and a rear cross member 154 which connects between the rear support links 44.

The prominent link of each all-linkage mechanism 30, 32 is the main longitudinal link 50 which supports the seat frame 22 and side frame or frames 24. Main longitudinal link 50 has its forward end directly supported at pivot 52 by the front support link 42, and has its rearward end indirectly supported by the recline linkage assembly 100. The main longitudinal link 50 further includes front and rear flanges 66, 68 which protrude outwardly from the main longitudinal link 50 for supporting and securing the seat frame 22 and side frame 24. The mid portion of the main longitudinal link 50 includes an attachment flange 70 for securing the cable 240 of the trip link assembly 234. An aperture 72 for journally supporting the square drive rod 80 is provided generally below this attachment flange 70. A bearing 74 is provided in aperture 72 for allowing the square drive rod 80 to easily rotate within aperture 72.

Referring briefly to FIGS. 8, 10 and 11, the adjustable seat slide 82 associated with each all-linkage mechanism 30, 32 is shown in more detail. More specifically, each main longitudinal link 50 is provided with an elongated aperture 76 for receiving a two piece nylon insert 78, thereby forming the lost motion slot 84 of the adjustable seat slide 82. Two metal friction washers 86 are provided on each side of the nylon insert 78. A threaded slide pin 88 having a head is extended through each friction washer 86 and thus through lost motion slot 84 for securing to other links of the mechanism. The threaded slide pin 88 also extends through the top pivot 52 of front support link 42, through the forward aperture 62 of the secondary connecting link 60, and finally through a washer 92. A tensioning spring 94 is retained on the inboard end of the threaded slide pin 88 by an adjustable fastener, such as a wing nut 96. Accordingly, the amount of compression between friction washers 86 and the nylon insert 78 of the seat slide assembly 82 can be adjusted by correspondingly adjusting the amount of tension provided by wing nut 96.

The adjustable seat slide 82 controls how easily the main longitudinal link 50 can move with respect to pivot 52 of front support link 42. Thus, the adjustable seat slide 82 controls the amount of friction placed on front pivot 52 during the reclining motion between the upright position and the intermediate position, and especially controls the amount of friction placed on nylon insert 78 as the main longitudinal link 50 moves between the intermediate and fully reclined positions. The adjustable seat slide 82 can be most easily accessed and adjusted from the front of reclining chair 20 when the leg rest assembly 28 is fully extended. The unique front access feature allows the seat slide 82 to be adjusted without moving the chair, or turning the chair over to access the mechanism. The advantage of a front access adjustment mechanism becomes even more significant when the wall proximity reclining chair 20 is incorporated into a love seat, sofa, or modular sofa, which could not be easily moved to access the adjustment feature. By rotating the wing nut 96 of each adjustable seat slide, the motion of each all-linkage assembly 30, 32 can be adjusted for various sized seat occupants. Thus, the advantage of the adjustable seat slide 82 is that the reclining chair 20 can be adjusted for very smooth and consistent operation. Unlike other wall proximity relining chairs known to recline too quickly or too slowly, which produce an unnatural motion, the relining chair of the present invention can be adjusted to operate evenly throughout the recline phases.

Figure 7:
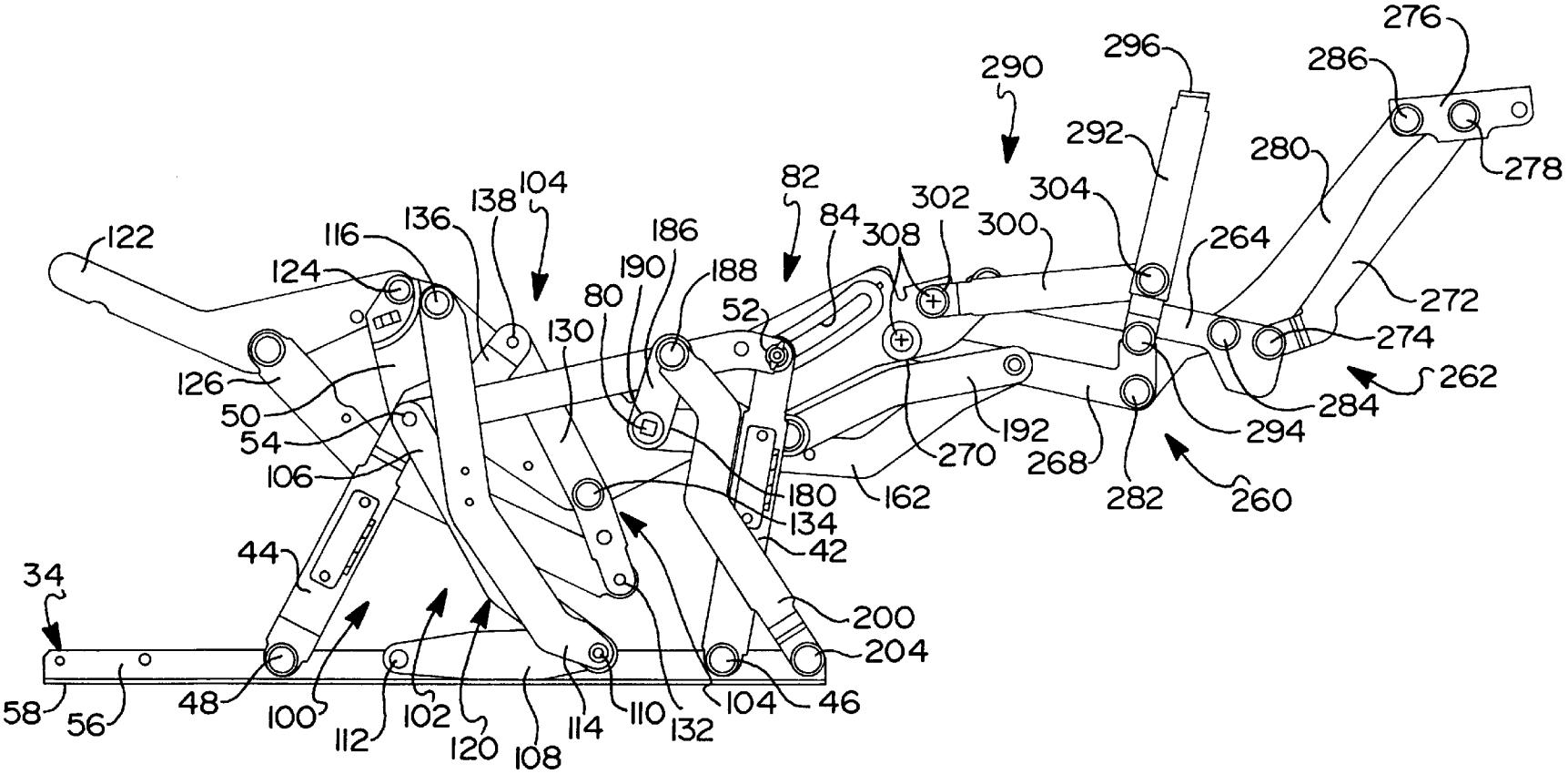
FIG. 7 is an inside elevational view of the all-linkage mechanism shown in the fully reclined position, also in accordance with a preferred embodiment of the present invention.
Figure 8:
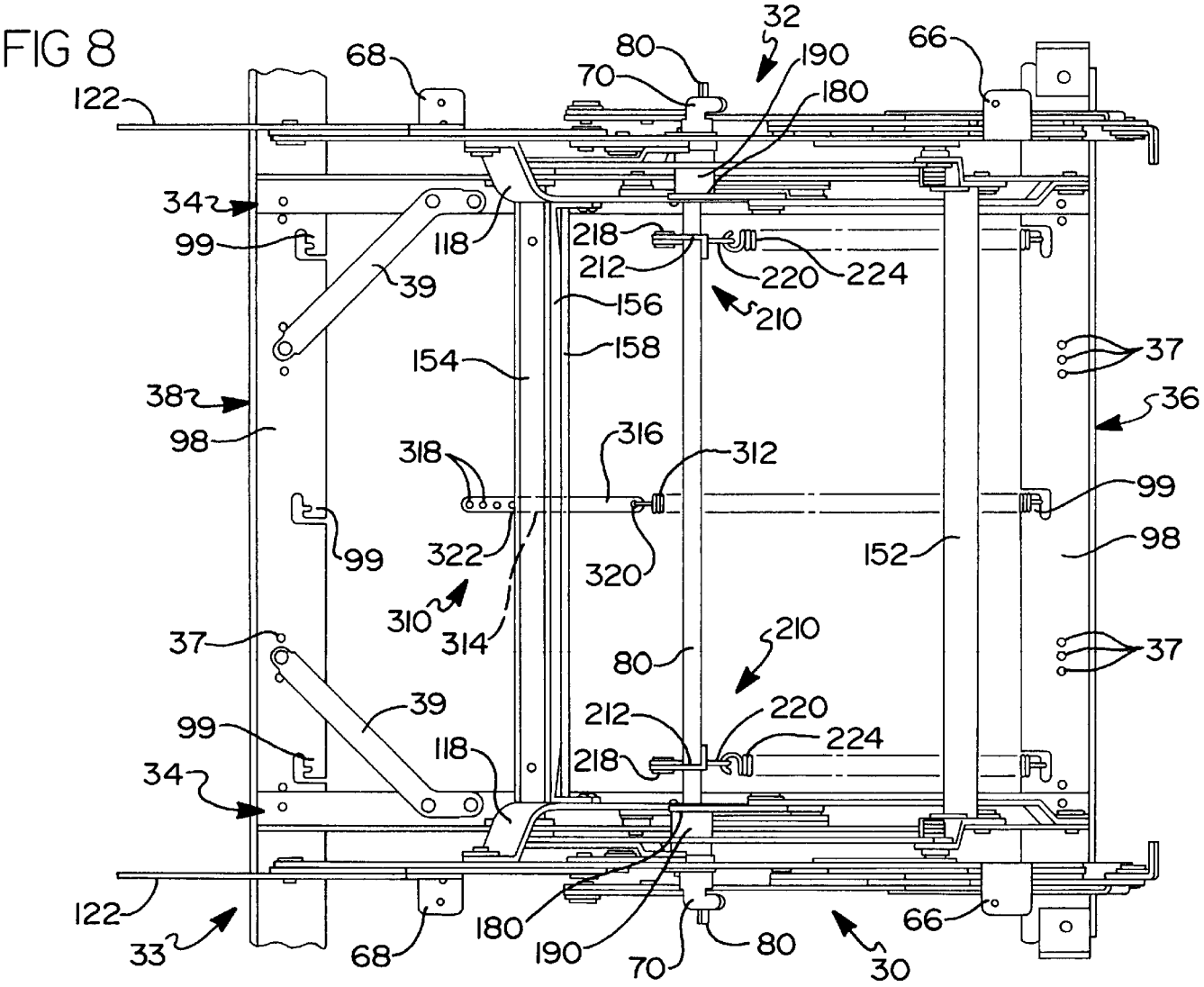
FIG. 8 is a top plan view showing the left and right all-linkage assemblies interconnected with various cross members in accordance with a preferred embodiment of the present invention.

Referring now to FIGS. 2 through 8, each all-linkage mechanism 30, 32 includes a recline linkage assembly 100 which is further defined by a first position recline linkage 102, and a second position recline linkage 104. With particular reference to FIGS. 3, 5 and 7, all inside views, the first position recline linkage 102 of the recline linkage assembly 100 is disclosed. More particularly, the first position recline linkage 102 includes a first connecting link 106 which is pivotally coupled at its top portion to the top of rear support link 44, and also connected to the rear portion of the secondary longitudinal link 60 at pivot 54. The bottom portion of first connecting link 106 is pivotally coupled to a base connecting link 108 at pivot 110. The opposite end of the base connecting link 108 is coupled to the vertical flange 56 of the longitudinal base rail 34 at pivot 112. Finally, a second connecting link 114 is also pivotally coupled to both the base connecting link 108 and the first connecting link 106 at pivot 110. The top portion of the second connecting link 114 is pivotally coupled to the rear portion of the main longitudinal link 50 at pivot 116. The second connecting link 114 further includes a curved offset top portion 118, and is preferably formed from heavy gauge steel. Thus, the first position recline linkage 102 is formed by the interconnection of first connecting link 106, base connecting link 108 and second connecting link 114.

The primary function of the first position recline linkage 102 is to control the forward motion of the four-bar linkage 40 supporting the main longitudinal link 50 as the chair 20 reclines away from the wall surface into the intermediate position. In operation, the first connecting link 106 allows the four-bar linkage 40 to pivot forwardly while the base connecting link 108 rotates clockwise about pivot 112 until the base connecting link 108 engages the horizontal flange 58 of the longitudinal base rail 34 (FIGS. 3 and 5). Once the base connecting link 108 is prevented from further rotating, the four-bar linkage 40 is retained in a locked position and is prevented from pivoting and moving forward, thus forming an exceptionally stable base for supporting the seat occupant in the intermediate position. The second connecting link 114 then provides additional support to the rear portion of the main longitudinal link 50. As best viewed in FIG. 8, the second connecting links 114 of each recline linkage assembly 100 are interconnected by a cross member 156 having attachment flanges at each end. Cross member 156 is further reinforced by a central strengthening rib 158, which is preferably formed during the stamping process. The combination of the first connecting link 106, base connecting link 108 and second connecting link 114 form a tripartite linkage assembly 120, with the base connection link 108 disposed between the first connecting link 106 and the second connecting link 114. This interconnection forming tripartite linkage assembly 120 provides a connection which balances the forces placed upon each side of the base connecting link 108, thereby enhancing the operation of the all-linkage mechanisms 30, 32.

With reference now to FIGS. 2 and 7, the second position recline linkage or recline control link 104 of the recline linkage assembly 100 is described in more detail. The primary function of the recline control link 104 is to control the forward motion of the main longitudinal link 50 from the intermediate position to the fully reclined position, and to control the reclining motion of the seat back 26. The recline control link 104 includes a seat back support link 122 having its forward end coupled to the main longitudinal link 50 at pivot 124. As presently preferred, pivot 124 is located approximately in line with the biomechanical hinge point (H-point) between the torso and the legs of an occupant properly seated in reclining chair 20. More specifically, as illustrated in FIG. 2 pivot 124 is located forward of line 26' defined by the front edge of seat back frame 26 and above line 22' defined by the upper edge of seat frame 22. In this way, the movement of pivot 124 during reclining movement coincides with H-point. In addition, the forward location of pivot 124 minimizes the overall fore-aft length of all-linkage reclining mechanisms 30, 32, thereby enabling the use of this reclining mechanism in substantially smaller, compact chair frames than previously required.

A recline connecting link 126 is pivotally coupled at its top portion to the seat back support link 122 at pivot 128. The lower and forward end of the recline connecting link 126 is pivotally coupled to the lower end of the vertical pivoting drive link 130 at pivot 132. The vertical pivoting drive link 130 is connected to the lower middle portion of the main longitudinal link 50 at pivot 134. The upper end of the vertical pivoting drive link 130 is pivotally connected to the forward end of a pivot control link 136 at pivot 138. The rear end of the pivot control link 136 is commonly connected to pivot 54 of the rear support link 44. A lost motion slot 140 is formed within the mid section of the pivot control link 136, which is retained against the secondary longitudinal link 60 by a stud 142 secured within the secondary longitudinal link 60. The combination of the lost motion slot 140 and the stud 142 allows for movement between these links, while also preventing deflection of the links during the reclining phases.

As previously described, the present invention provides a compact reclining mechanism which is particularly well-suited for to incorporate reclining motion into a wide variety of sizes and styles of chairs, love seats, and sofas. The geometry and interconnection of vertical pivoting drive link 130 plays an important part in this aspect of the present invention. More specifically, pivot 134 between vertical pivoting drive link 130 and main longitudinal link 50 is pushed as far forwardly as possible while maintaining the desired kinematic relationship between the various components of all-linkage reclining mechanisms 30, 32. As a result, vertical pivoting drive link 130 is positioned and between front and rear support links 42, 44 and remains so positioned during the entire range of motion of all-linkage reclining mechanisms 30, 32.

The upstanding portion 144 of the seat back supporting link 122 includes a rearward facing notch 146 for receiving the locking cam mechanism 148 of the seat back connecting bracket 150. The seat back connecting bracket 150 is secured to the upright side frame member of the detachable seat back 26 with suitable fasteners. A more detailed description of the components associated with the seat back connecting bracket 150 can be found in U.S. Pat. No. 5,184,871, entitled "Detachable Chair Back," which is expressly incorporated herein by reference, and which is commonly owned by the Assignee of the present invention.

With reference now to FIGS. 2, 3 and 8, the square drive rod 80 and its associated drive assemblies are described in more detail. As best seen in FIG. 8, square drive rod 80 is journally supported at each end by the main longitudinal links 50. A series of drive links are secured to the square drive rod 80 which perform various functions associated with the all-linkage mechanisms 30, 32. As best viewed in FIG. 2, an outboard drive link 160 is rigidly secured at each end of square drive rod 80. The opposite end of the outboard drive link 160 is pivotally connected to the outboard pantograph connecting link 162 at pivot 164. The outboard drive link 160 and the outboard pantograph connecting link 162 serve to initiate the extension of leg rest assembly 28 via pantograph linkage assembly 260. The combination of these links also serve as an over-center mechanism to lock the leg rest assembly 28 in the retracted position. The universally shaped outboard drive link 160 can be used on both ends of the square drive rod 80, and includes a connecting flange 166 for engaging a flat surface of the square drive rod 80. The connecting flange 166 is preferably secured to the square drive rod 80 with a threaded fastener 168. The outboard drive link 160 further includes a recessed portion 170 for receiving a stopping stud 172 formed on the outboard pantograph connecting link 162. The stopping stud 172 prevents the over-retraction of the leg rest assembly 28 when the outboard drive link 160 is in the over-center position (FIGS. 2 and 12A).

The square drive rod 80 also includes an inboard drive link 180 which is journally supported on square drive rod 80. The inboard drive link 180 is supported by the square drive rod 80 near the inside face of the main longitudinal link 50 which serves to reduce the bowing forces placed on the square drive rod 80. The inboard drive link 180 includes a first drive arm 182 which is pivotally connected to the inboard pantograph connecting link 192 at pivot 184, and a second drive arm 186 which is pivotally connected to the control link 200 at pivot 188. In the preferred embodiment, various pivots in all-linkage mechanisms 30, 32 such as pivots 116, 124, 134, 184, 204 and 308 are formed using a screw-in or threaded rivet 308 which facilitates easier manufacturing and service. However, one skilled in the art will readily recognize that threaded rivet 308 could be utilized at other pivots as well.

Figure 17:
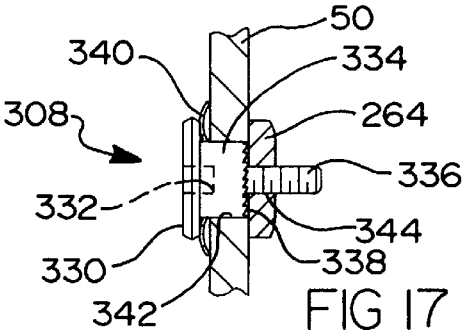
FIG. 17 is a cross-sectional view of the pivot point of the linkage mechanism taken along line 17—17 shown in FIG. 2 which illustrates a threaded rivet utilized at various pivot locations within the all-linkage reclining mechanism.

While any suitable rivet fastener may be utilized for threaded rivet 308, a presently preferred threaded rivet is illustrated in FIG. 17. With specific reference thereto, threaded rivet 308 includes headed portion 330 having a drive socket 332 formed in a face thereof. Shoulder portion 334 extends from head portion 330 on a side opposite drive socket 332. Threaded portion 336 extends from shoulder portion 334 and has a self-tapping thread formed thereon. An annular surface 338 extending radially outwardly from threaded portion 336 includes a serrated self-locking surface formed thereon. Threaded rivet 308 further includes wave washer 340 disposed about shoulder portion 334 and engaging the back side of headed portion 330. In this manner, threaded rivet 308 is used to facilitate pivotal coupling of various components associated with all-linkage reclining mechanisms 30, 32. With continued reference to FIG. 17, threaded rivet 308 pivotally connects main longitudinal support link 50 with pantograph support link 264. More specifically, aperture 342 is formed in main support link 50 and provides a clearance hole for shoulder portion 334 of threaded rivet 308. Pantograph support link 264 has an aperture 344 formed therethrough which cooperates with threaded portion 336 of threaded rivet 308. Upon installation, threaded rivet 308 is driven into and taps aperture 344 until serrated face 338 engages a surface of pantograph support link 264 to lockingly retain threaded rivet 308 thereto. Wave washer 340 biases main longitudinal link 50 against pantograph support link 264, thereby removing any looseness in the pivotal coupling provided therebetween. In addition, shoulder portion 334 may be provided with a suitable lubricant, such as lithium grease, to decrease the friction at pivot 308. In this way, threaded rivet 308 provides an efficient and effective means for pivotally coupling various links within the linkage reclining mechanism without requiring the difficult task of placing the all-linkage reclining mechanism within a riveting apparatus during assembly. Furthermore, threaded rivet 308 facilitates field surface of the linkage mechanisms by making them removable with a standard drive wrench.

With continued reference to FIGS. 2 and 8, the first drive arm 182 and the second drive arm 186 are preferably welded to a cylindrical connecting ferrule 190 having a circular inner portion which slips over the square drive rod 80. The connecting ferrule 190 maintains a rigid connection between the first drive arm 182 and the second drive arm 186. This rigid connection allows power to be transferred from control link 200 and second drive arm 186, through the first drive arm 182 and inboard pantograph connecting link 192, and to the pantograph linkage assembly 260 for fully extending the leg rest assembly 28. Connecting ferrule 190 is supported on square drive rod 80 by a pair of plastic bushings (not shown), preferably nylon. Accordingly, inboard drive link 180 is journally supported by, and can move independently of square drive rod 80.

Turning specifically to FIGS. 3, 5 and 7, the S-shaped control link 200 of each all-linkage mechanism 30, 32 is connected between the second drive arm 186 of the inboard drive link 180 at upper pivot 188, and the vertical flange 56 of the longitudinal base rail 34 at lower forward pivot 204. As disclosed, pivot 204 of control link 200 is forward of pivot 46 of the front support link 42. The control link 200 cooperates with the inboard drive link 180, in accordance with the gravity driven and spring biased operation of this mechanism, to impart the primary rotational force on the inboard drive link 180 (about the square drive rod 80) for extending the leg rest assembly 28, and to control the reclining of the all-linkage mechanisms 30, 32 from the upright position to the intermediate or TV position. More specifically, as the all-linkage mechanisms 30, 32 move forwardly and away from the wall into the intermediate position, the pair of control links 200 (one for each all-linkage mechanism 30, 32) force the angular rotation of the inboard drive link 180. The connection of the first drive arm 182 of the inboard drive link 180 to the inboard pantograph connecting link 192 forces the extension of the leg rest assembly 28 via pantograph linkage assembly 260 as the mechanisms 30, 32 and chair 20 recline into the intermediate position.

However, the geometry of the interconnections between control link 200, and the inboard drive link 180 and base rail 34 contributes to the proper operation of the leg rest assembly 28. More specifically, as the all-linkage mechanisms 30, 32 move from the intermediate position to the fully reclined position, the leg rest assembly 28 must be maintained in the fully extended position. This in turn requires that the inboard drive link 180 and its first and second drive arms 182, 186 also maintain a constant position as the main longitudinal links 50 move forwardly into the fully reclined position. When comparing FIGS. 5 and 7, it can be seen that control link 200 rotates in a clockwise direction about pivot 204 as the main longitudinal link 50 moves forwardly and upwardly into the fully reclined position. While the purpose of control link 200 is to impart a rotational force on inboard drive link 180 for extending the leg rest assembly 28 during the first or intermediate recline phase, the control link 200 must keep the inboard drive link 180 stationary during the second or full recline phase as the control link 200 rotates about lower pivot 204. This is accomplished through the locations and geometries associated with the pivots 188 and 204 of the control link 200 in combination with the length of the second drive arm 186 and the curvilinear path defined by lost motion slot 84 and pivot 52 associated with the adjustable seat slide assembly 82. Accordingly, one skilled in the art will appreciate that as the lost motion slot 84 moves forwardly with respect to front pivot 52, control link 200 can rotate clockwise about pivot 204 without causing any further rotation of the inboard drive link 180 through second drive arm 186. Thus, the leg rest assembly 28 is maintained in the fully extended position as the all-linkage mechanisms 30, 32 move from the intermediate position to the fully reclined position.

Referring now to FIGS. 8 and 9, each all-linkage mechanism 30, 32 further includes a spring assist drive linkage 210 interconnected between the square drive rod 80 and the front frame rail 36. The spring assist drive linkage 210 includes an over-center drive link 212 which is rigidly secured to the square drive rod 80 with an attachment flange 214. The attachment flange 214 is preferably secured to the square drive rod 80 with a threaded fastener 216. As disclosed, fastener 216 is a TORX® fastener. The opposite or rearward facing end of the over-center drive link 212 (when chair 20 is in the upright position, FIGS. 2 and 3) includes a pivot 218 for connecting to C-shaped over-center connecting link 220. An aperture 222 is formed in the opposite end of the C-shaped over-center connecting link 220 for retaining a biasing spring 224 which connects between the over-center connecting link 220 and one of the spring retaining tabs 99 formed in the horizontal flange 98 of the front frame rail 36. In operation, the spring assist drive linkage 210 imparts a biasing force on square drive rod 80 in either a clockwise or counterclockwise direction, depending on which side of the center line the C-shaped over-center connecting link 220 is located. The spring assist drive linkage 210 biases drive rod 80 in a first direction when the leg rest assembly 28 is extended, and biases drive rod 80 in a second, opposite direction when the leg rest assembly is retracted. Thus, the spring assist drive linkage 210 provides square drive rod 80 with a rotational mechanical advantage, while also providing a forward force which serves to pull each all-linkage mechanism 30, 32 with respect to the front frame rail 36, from the upright position to the intermediate and fully reclined positions.

The wall proximity reclining chair 20 is also provided with an adjustable drive spring assembly 310 which provides a forward bias to the four-bar linkage 40, and assists in the reclining of the chair 20. As best illustrated in FIG. 8, the adjustable drive spring 312 extends generally between the front frame rail 36 and the rear crossmember 154. A horizontal slot 314 formed in the rear crossmember 154 receives a spring adjustment bracket 316 having a series of holes 318, preferably seven, formed therein. The forward and lower end of the drive spring 312 is secured within one of the spring retaining tabs 99 formed in the horizontal flange 98 of the front frame rail 36. The opposite end of drive spring 312 is secured within an aperture 320 formed in the forward end of the spring adjustment bracket 316. A retaining pin 322 can be selectively placed within one of the series of holes 318. By changing the location of retaining pin 322 within the series of holes 318, the amount of tension on drive spring 312, and thus the amount forward force provided to the four-bar linkage 40 can be selectively adjusted.

With reference now to FIGS. 12A and 12B, the cable release assembly 230 which initiates the recline function from the upright position to the intermediate position is described in more detail. The cable release assembly 230 includes the cable release mechanism 232, mounted to the side frame 24 of the chair 20, and the trip link assembly 234, which is mounted to the main longitudinal link 50 at various points. While only one cable release assembly 230 is required, the cable release assembly 230 can be mounted to either side of the wall proximity reclining chair 20. The cable release mechanism 232 includes a release handle 236 pivotally mounted to handle bracket 238. One end of the release cable 240 is secured to the release handle 236, and the other end of the release cable 240 is mounted to the trip link assembly 234. The outside sheathing 242 of the release cable 240 is secured between the handle bracket 238 at one end, and the cable mounting flange 70 of the main longitudinal link 50 at the opposite end. The end of the outside sheathing 242 which attaches to cable mounting flange 70 is provided with a slotted flag 258 that can be easily slipped over cable mounting flange 70. The aperture formed in slotted flag 258 fits snugly around mounting flange 70 and can be securely retained without a fastener. This feature allows for ease in manufacturing, and also facilitates in-field service because the slotted flag 258 can be easily slipped on and off mounting flange 70.

The trip link assembly 234 includes an L-shaped trip link 250 coupled to the main longitudinal link 50 at pivot 244. The L-shaped trip link 250 has an upper retaining pin 246 and a lower engaging pin 248 secured thereto. The details of trip link 250 are best illustrated in FIG. 12C. The upper retaining pin 246 includes a circular recess 252 for retaining the release cable 240 and a biasing spring 254. An eyelet 241, secured to the end of cable 240, slips over retaining pin 246, and past circular recess 252. The hook end of biasing spring 254 is placed into circular recess 252, which serves to secure spring 254 onto retaining pin 246, and also to lock the eyelet 241 onto retaining pin 246. The opposite end of the biasing spring 254 is secured within notch 256 formed on a rearward edge of the main longitudinal link 50. The biasing spring 254 retains the trip link 250 in its upper retracted position. The biasing spring 254 also helps to secure slotted flag 258 around cable mounting flange 70 because the release cable 240 is always under tension. The lower engaging pin 248 extends outwardly from the L-shaped trip link 250 for engaging the top edge or cam surface 174 of the outboard drive link 160. The geometry of cam surface 174 has been designed with a specific slope angle Θ to optimize the release action provided by the cable release assembly 230. As disclosed, the slope angle Θ provides additional mechanical advantage to trip link 250 for rotating outboard drive link 160. The slope angle Θ of cam surface 174 also enables lower engaging pin 248 to sufficiently rotate outboard drive link 160 for initiating extension of the leg rest assembly 28 by utilizing approximately one half of the stroke of release handle 236. Preferably, slope angle Θ is approximately 10 degrees. However, one skilled in the art will appreciate that variations in slope angle Θ are within the slope of the present invention.

When the wall proximity reclining chair 20 is in its upright position, the outboard drive link 160 is locked into its retracted and over-center position with respect to the square drive rod 80. In operation, the L-shaped trip link 250 serves to engage and rotate the outboard drive link 160 downwardly and forwardly, thus rotating the square drive rod 80 counterclockwise, as the release handle 236 is pulled outwardly from the chair side frame 24. The forward rotation of outboard drive link 160 and outboard pantograph connecting link 162 initiates the extension of the leg rest assembly 28 through the pantograph linkage assembly 260. As the L-shaped trip link 250 rotates the outboard drive link 160 counterclockwise, and thus over the center-line position, the gravity actuated feature of the wall proximity chair 20 drives the various reclining linkages into the intermediate reclined position.

Referring back to FIGS. 2 through 7, the leg rest assembly 28 of the wall proximity reclining chair 20 is disclosed in more detail. The leg rest assembly 28 includes a pantograph linkage assembly 260 having a foot rest linkage 262 and an ottoman linkage 290. The pantograph linkage assembly 260 is pivotally coupled to the main longitudinal link 50 via pantograph support link 264 at pivot 266, and pantograph drive link 268 at pivot 270. In the preferred embodiment, pivots 266 and 270 are formed using screw-in rivets 308 which secure the respective links. These screw-in rivets 308 serve a dual purpose. First, the screw-in rivets 308 make each all-linkage mechanism 30, 32 easier to manufacture because the pantograph linkage assembly 260 can be secured to the main longitudinal link 50 after each sub-assembly is fabricated. This eliminates the need for specialized fixtures for supporting the entire mechanism during assembly at the riveting station. Second, the screw-in rivets 308 allow the pantograph linkage assembly 260 to be serviced in the field. If for some reason, the pantograph linkage assembly 260 becomes inoperable after the chair has been purchased, the screw-in rivets 308 allow for replacement in the field without sending the reclining chair 20 back to the factory.

With continued reference to FIGS. 2 through 7, a forward connecting link 272 is connected to the forward end of the pantograph support link 264 at pivot 274. The opposite end of the forward connecting link 272 is also connected to the foot rest support link 276 at pivot 278. A rearward connecting link 280 includes a first pivot 282 for connecting to the pantograph drive link 268, an intermediate pivot 284 for connecting to the pantograph support link 264, and a forward pivot 286 for connecting to the foot rest support link 276. A foot rest board 288 is supported at each end by the foot rest support links 276 of each foot rest linkage 262.

In the preferred embodiment, the leg rest assembly 28 includes an ottoman linkage assembly 290 which provides more continuous leg support to the seat occupant. The ottoman linkage 290 includes an ottoman support link 292 which connects to pivot 294 of the pantograph drive link 268. The opposite end of the ottoman support link 292 includes a flange 296 for supporting the mid-ottoman board 298. An ottoman control link 300 is connected between the main longitudinal link 50 at pivot 302 and a mid-portion of the ottoman support link 292 at pivot 304. As described above, pivot 302 is also preferably a screw-in rivet 308 for allowing easier manufacturing and replacement of the pantograph linkage assembly 260. The upholstered and cushioned mid-ottoman board 298 rests behind the foot rest board 288, when the chair 20 is in the upright position. As the all-linkage mechanisms 30, 32 move from the upright position into the intermediate position, the ottoman linkage 290 extends forwardly and upwardly, thereby moving the mid-ottoman board 298 between, and in line with the foot rest board 288 and the upholstered seat cushion, positioned on the seat frame 22. Accordingly, the upholstered seat cushion, mid-ottoman board 298 and leg rest board 288 provide a continuous line of leg support for enhancing the overall comfort of the reclining chair 20.

The outboard pantograph connecting link 162 and the inboard pantograph connecting link 192 both connect to the pantograph drive link 268 at common pivot 306. The opposite ends of the outboard and inboard pantograph connecting links 162, 192 are respectively coupled to their associated drive links 160, 180. As described above, the primary purpose of outboard drive link 160 and outboard connecting link 162 is to initiate the extension of the pantograph linkage assembly 260, and to initiate rotation of the inboard drive link 180 about square drive rod 80 via inboard pantograph connecting link 196. Once the inboard drive link 180 rotates to move the control link 200 past its over center position, the spring assist drive linkage 210 and the adjustable drive spring assembly 310 provide additional forward biasing for transporting the four-bar linkage 40 into the partially reclined position. As can be appreciated from the above description in view of the drawings, inboard drive link 180 and inboard pantograph connecting link 192 provide the primary mechanical force on pantograph drive link 268 for extending and retracting each pantograph linkage assembly. This design feature further enhances the operation of the gravity driven recline function of the present invention.

With continued reference to FIGS. 2 through 7, in view of FIGS. 1A through 1C, the functional operation of wall proximity reclining chair 20 is described in more particular detail. Each all-linkage mechanism 30, 32 is maintained in its upright position by its spring assist drive linkage 210. More specifically, the biasing spring 224 which extends between the front frame rail 36 and C-shaped over center connecting link 220 forces square drive rod 80 into its retracted position through over-center drive link 212, thereby locking the reclining chair 20 in the upright position. As discussed above, the outboard drive link 160 is also held in an over-center condition. However, the outboard drive link 160 is prevented from over retracting the leg rest assembly 28 by stopping stud 172 of the outboard pantograph connecting link 162. Additionally, the control link 200 is also designed as a over-center mechanism which also serves to lock the reclining chair 20 in the upright position. Pressure from a seated occupant causes the control link 200 to impart a clockwise rotational force on inboard drive link 180, and thus serves to keep the leg rest assembly 28 retracted, and the chair 20 in the upright position.

Upon initiating the trip link assembly 234, the leg rest assembly 28 begins to extend, and the main longitudinal link 50 then begins moving forwardly via the front and rear support links 42, 44, which are pivotably coupled to the vertical flange 56 of the longitudinal base rail 34. As the main longitudinal link 50 moves forwardly into the partially reclined position, the rear portion of the main longitudinal link 50 moves forwardly and downwardly as the triangular linkage formed by the rear support link 44, first connecting link 106, base connecting link 108, and second connecting link 114, rotates downwardly about pivot 112 until the tripartite linkage assembly 120 contacts the horizontal flange 58 of the longitudinal base rail 34. The base connecting link 108 pivots forwardly and downwardly about its base rail pivot 112. Eventually, the tripartite linkage assembly 120, and especially the base connecting link 108, bottoms out against the longitudinal base rail 34. The mechanism is designed so that the leg rest assembly 28 is fully extended when the base connecting link 108 contacts the base rail 34. The forward and downward motion of the rear portion of the main longitudinal link 50 causes the seat back 26 to also move downwardly and to be tipped rearwardly through the seat back support link 122 and recline connecting link 126.

During this initial reclining motion, the control link 200 moves across its pivotable center line and into its primary range of operation. Furthermore, the control link 200 forces the extension of the pantograph linkage assembly 260 through the rotation of inboard drive link 180 about square drive rod 80 as the mechanism travels forwardly and downwardly in conjunction with the main longitudinal link 50. As discussed above, the first position recline linkage 102 is primarily responsible for controlling the motion of the main longitudinal link 50 as the all-linkage mechanism 30, 32 travels from the upright position to the intermediate position. It should be noted that the second position reclining linkage 104 remains essentially stationary while the main longitudinal link 50 is transported from the upright position to the intermediate position. It should also be noted that the seat back 26 cannot be reclined until the leg rest assembly 28 is fully extended. Likewise, the seat back 26 must be in the upright position before the leg rest assembly 28 can be fully retracted.

The second recline phase is initiated by rearward and downward pressure on the seat back 26, which correspondingly pivots the seat back support link 122 downwardly about its front pivot 124 with the main longitudinal link 50. The recline connecting link 126 is then driven forwardly. The forward driving motion of the recline connecting link 126 causes the vertical pivoting drive link 130 to rotate in a counter clockwise direction about its middle pivot 134 with the lower portion of the main longitudinal link 50. Accordingly, the force provided by the seat occupant leaning back into seat back 26 provides the requisite leveraging force through recline control link 104 to the recline connecting link 126 and the vertical pivoting drive link 130 to forwardly drive the main longitudinal link 50 with respect to the adjustable seat slide 82. The recline control link 104 and the adjustable seat slide 82 further allow the seat occupant to achieve an infinite number of positions within the range of motion provided by lost motion slot 84.

The front and rear support links 42, 44 remain completely stationary while the main longitudinal link 50 is driven forwardly and upwardly via the front seat slide 82 and recline control link 104 when the all-linkage mechanism 30, 32 is fully reclined. Additionally, the first connecting link 106 and base connecting link 108 of the tripartite linkage assembly 120 also remain stationary during the second recline phase. However, the second connecting link 114 pivots about its lower pivotable connection in a forward and upward movement about this lower pivot 110 during the second recline phase. This motion correspondingly drives the rear portion of the main longitudinal link 50 in a forward and upward direction. Accordingly, the seat frame 22 and seat back 26 achieve a flatter reclined position.

The chair 20 is moved from the fully reclined position to the intermediate position by the seat occupant leaning forward so that the main longitudinal link 50 slides rearwardly about front seat slide 82 and recline control link 104. Once in this position, the leg rest assembly 28 can be retracted by the seat occupant to move and lock the reclining mechanisms 30, 32 into the upright position. This is accomplished by the seat occupant placing downward and rearward pressure on the leg rest assembly 28, which causes the leg rest assembly 28 to retract and the chair 20 to move from the intermediate position to the upright position. When the leg rest assembly 28 is fully retracted, the outboard drive link 160 is moved into its over center position, thereby locking the all-linkage mechanisms 30, 32 into the upright position. Extension of the leg rest assembly 28 can then be initiated by activating the trip link assembly 234.

With reference now to FIGS. 13–16, a second preferred embodiment of the present invention is illustrated. More specifically, compact reclining chair 410 includes a chair frame 412 operably coupled to a base frame 414 through a pair of all-linkage reclining mechanisms 416, 418. Swivel base assembly 420 is secured to a bottom portion of base frame 414 to provide a rotational degree of freedom by a vertical axis of compact reclining chair 410.

Figure 13A:
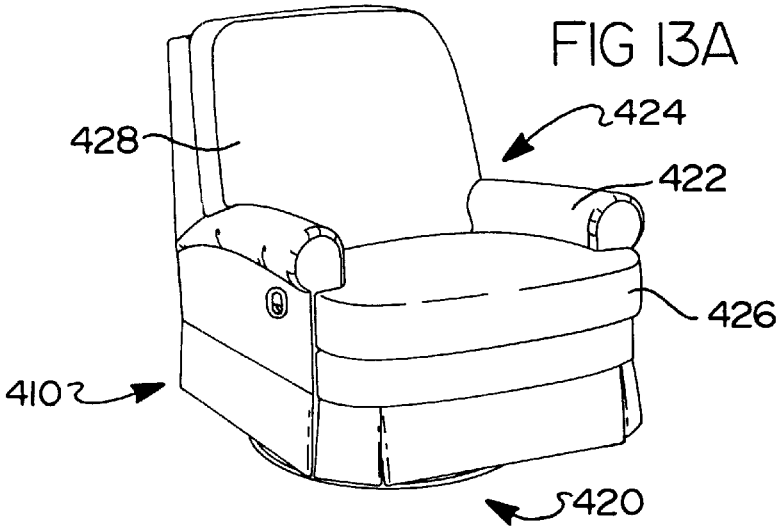
FIGS. 13A–13C are perspective views of an alternate preferred embodiment of a swivel base reclining chair having an all-linkage reclining mechanism shown in the various operative positions, including an upright position with the leg rest assembly retracted, a partially reclined position with the leg rest fully extended, and a fully reclined position with the leg rest assembly extended and the seat back fully reclined.
Figure 13B:
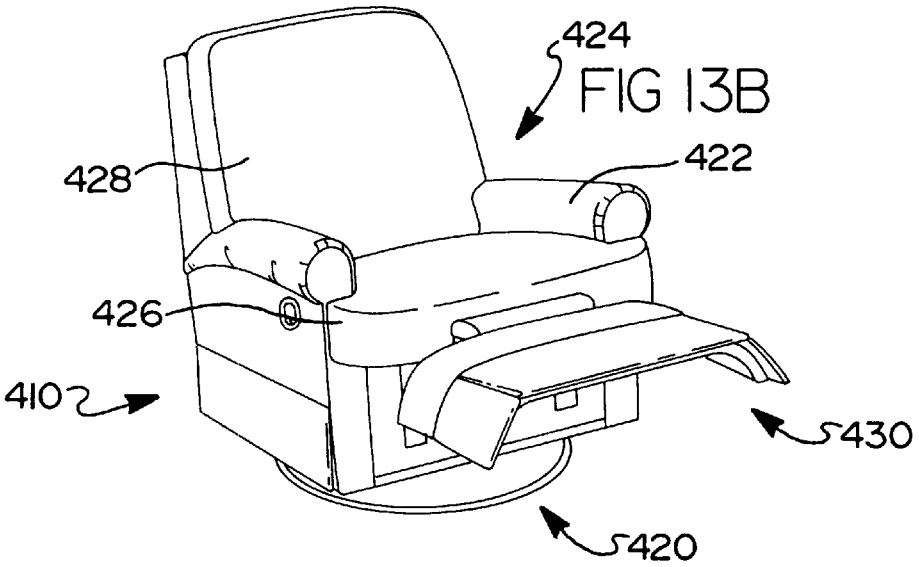
Figure 13C:
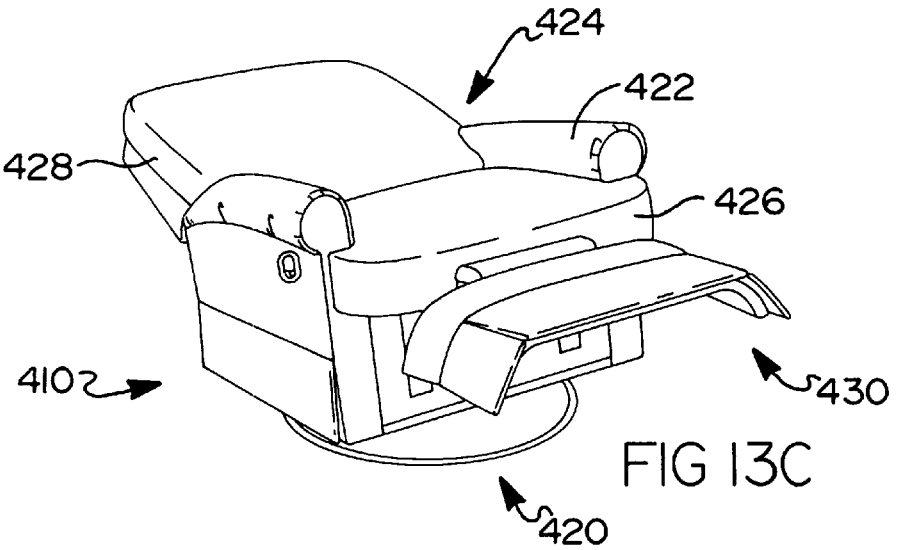

With specific reference now to FIGS. 13A–C, compact reclining chair 410 includes chair frame 412 having an arm rest or side frame 422, a seat assembly 424 having a seat frame 426 secured to side frame 422, a reclinable seat back 428 operably coupled to all-linkage reclining mechanisms 416, 418, and a movable leg rest assembly 430. Compact reclining chair 410 is illustrated its upright position, with leg rest assembly 430 retracted within the chair 410 in FIG. 13A. Upon manipulation of cable release mechanism 413, reclining chair 410 is positioned into a partially reclined or intermediate position, in which leg rest assembly 430 is fully extended and seat back 428 is partially reclined as illustrated in FIG. 13B. Chair frame 412 also tilts rearwardly and moves forwardly with respect to base assembly 414 when reclining chair 410 is moved from its upright position to its partially reclined position. Upon pressure being applied to seat back 428, reclining chair 410 is positioned into its fully reclined position as illustrated in FIG. 13C. It should be noted that leg rest assembly 430 must be fully extended before seat back 428 can begin reclining. As will be appreciated from FIG. 13C, when reclining chair 410 is in the partially reclined position, additional rearward pressure placed against seat back 428 urges side frame 422, seat 426 and leg rest assembly 430 forwardly and further tilts chair frame 412 rearwardly. Accordingly, all-linkage mechanism 416 maintains the rearward most edge of seat back 428 within approximately five to six inches (twelve to fifteen centimeters) during the range of motion achieved by reclining chair 410.

Figure 14:
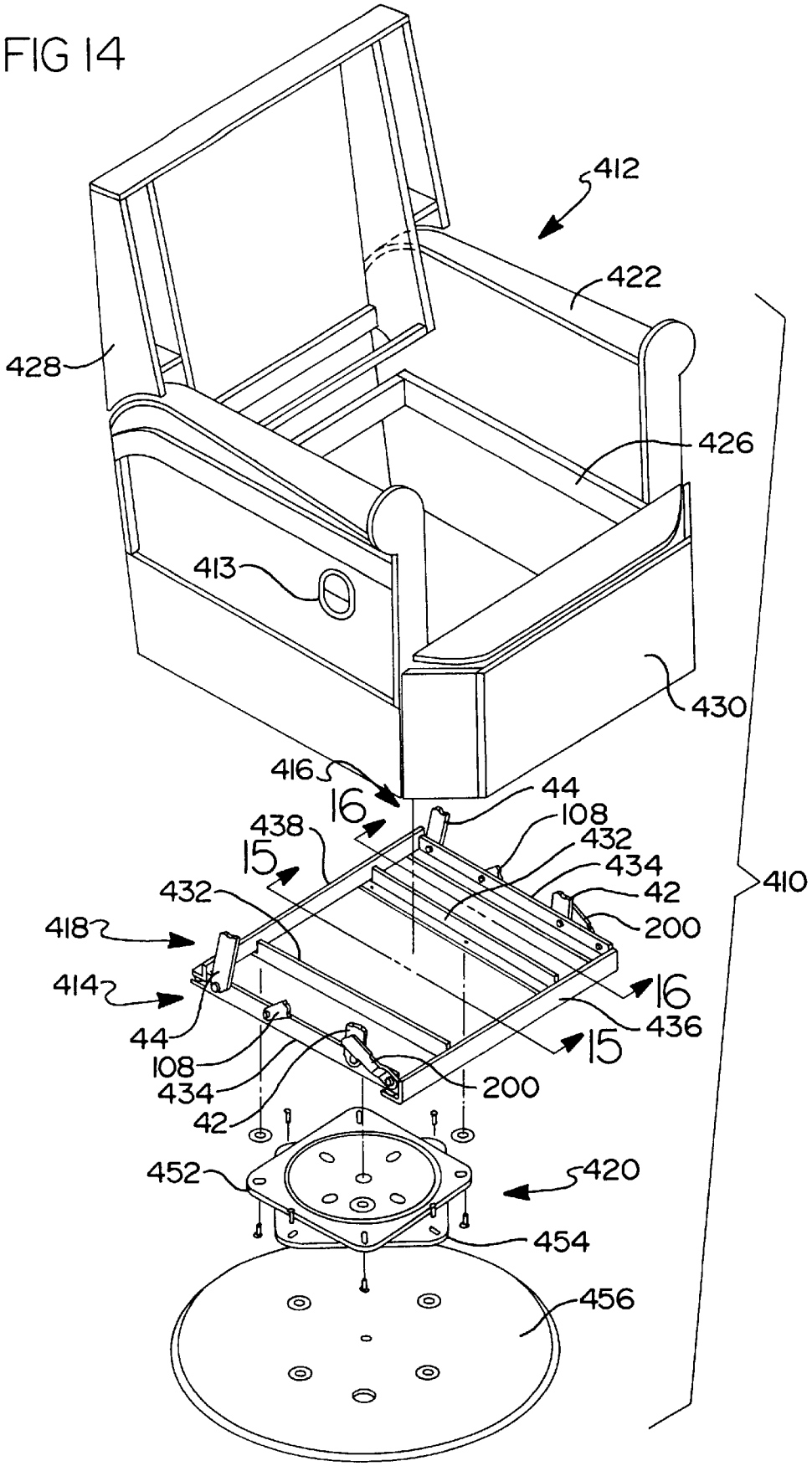
FIG. 14 is a simplified perspective view of the base frame and swivel base assembly utilized in the present invention.

Referring now to FIG. 14, only a portion of all-linkage mechanisms 416, 418 are illustrated. However, it should be readily appreciated that compact reclining chair 410 includes right and left all-linkage mechanisms 416, 418 which are identical to right and left all-linkage mechanisms 30, 32 illustrated in FIGS. 2–12 and described in particular reference to the first preferred embodiment of the present invention. Accordingly, components of all-linkage mechanisms 416, 418 which are identical to all-linkage mechanisms 30, 32 are given the same reference numerals with it being understood additional components not shown or described in the second preferred embodiment are identical to those described and illustrated heretofore. All-linkage mechanisms 416, 418 are operably coupled to base frame 414 which includes a pair of inboard longitudinal base rails 432 and a pair of outboard longitudinal base rails 434. Front cross rail 436 and rear cross rail 438 are secured to the front and rear ends of longitudinal base rails 432, 434, respectively, to define a rigid, generally rectangular support frame.

Figure 15:
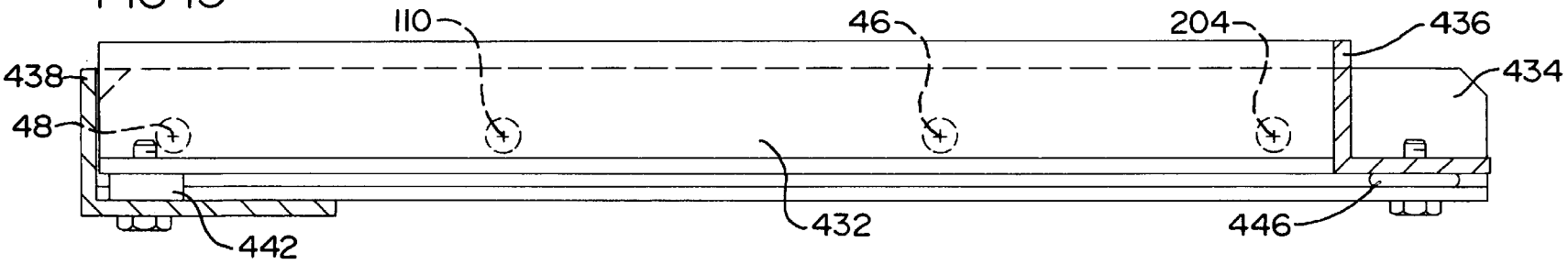
FIG. 15 is a cross-sectional view of the base frame taken along line 15—15 shown in FIG. 14.
Figure 16:
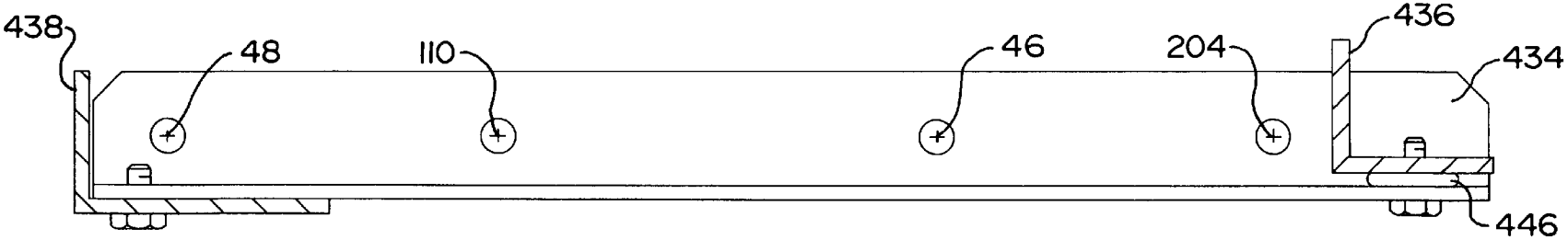
FIG. 16 is a cross-sectional view of the base frame taken along line 16—16 shown in FIG. 14.

More specifically, with reference to FIGS. 15 and 16, inboard longitudinal base rails 432, which have a generally "L-shaped" cross-section, form a welded butt joint at an inboard location on rear cross rail 438. The forward end 440 of inboard longitudinal base rail 432 is positioned above front cross rail 436 and secured thereto with a suitable fastener. Spacer 442 is disposed between forward end 440 and front cross rail 436 to maintain an approximately one-quarter inch gap therebetween. Similarly, a rear end 444 of outboard longitudinal rail 434 is disposed beneath and secured to rear cross rail 438 with a suitable fastener. Rear spacer 446 is disposed between rear end 444 and rear cross rail 438 to provide an approximately one-quarter inch space therebetween. A forward end of outboard longitudinal base rail 434 is disposed directly on top of front cross rail 436 and secured thereto with suitable fasteners. In this way, outboard longitudinal base rail 434 is situated below the remainder of base frame 414, thereby positioning all-linkage mechanisms in closer proximity to the floor.

With continued reference to FIG. 14, all-linkage mechanisms 416, 418 are operably coupled to base frame 414 and support chair frame 412 for reclining movement thereon. More specifically, all-linkage mechanisms 416, 418 include front support link 42, rear support link 44, base connecting link 108 and control link 200, all of which are pivotally connected to vertical flange 448 of outboard longitudinal base rail 434 at pivots 46, 48, 110 and 204, respectively.

As previously described, compact reclining chair 410 further includes swivel base assembly 420 which is secured to base frame 414 to provide a rotational degree of freedom of reclining chair 410 with respect to the floor. In this regard, swivel base assembly 420 includes swivel plate 450 having an upper plate 452, secured to inboard longitudinal base rails 432 at a forward location and rear cross rail 438 at a rearward location with suitable fasteners, and a lower plate 454 secured to floor base 456 with suitable fasteners. A bearing assembly (not shown) is operably disposed between upper plate 452 and lower plate 454 to permit relative rotational movement therebetween. It should be appreciated that swivel plate 450 is positioned within base frame 414 as a result of the location of outboard longitudinal base rails 434 below inboard longitudinal base rails 436, and front and rear cross rails 436, 438. While various swivel base assemblies may be utilized in the present invention, a presently preferred swivel base assembly which may optionally include a lock-out feature is presently preferred and further described and illustrated in U.S. application Ser. No. 08/950,484, filed on Oct. 15, 1997 and entitled "Swivel Base Lockout Assembly", which is commonly owned by the assignee of the present invention and the disclosure of which is expressly incorporated by reference herein.

While all-linkage mechanisms 416, 418 are adapted to receive a wide variety of sizes and styles of chair frames, their compact nature makes them particularly well suited for a compact, formal reclining chair. More specifically, the compact nature of the space requirements for all-linkage reclining mechanisms 416, 418, as well as the limited space requirement for operation of compact reclining chair 410 through its range of motion makes it particularly well suited for this application.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A reclining mechanism comprising:

a base frame;

a support linkage assembly including a first support link pivotally coupled to said base frame, a second support link pivotally coupled to said base frame, an intermediate link pivotally coupled to said first support link at a first pivot and pivotally coupled to said second support link at a second pivot, and a base connecting link pivotally coupled to said base frame at a first end and operably coupled to said intermediate link;

a longitudinal link operably coupled to said support linkage assembly;

a recline linkage assembly operably coupled between said longitudinal link and said base frame for controlling reclining movement of said longitudinal link from an upright position to a reclined position;

a rotatable drive rod journally supported by said longitudinal link and operably coupled thereto such that reclining movement of said longitudinal link rotates said drive rod in a first direction; and a leg rest assembly operably coupled to said longitudinal link for movement from a retracted position to an extended position in response to rotation of said drive rod in said first direction.

2. The reclining mechanism of claim 1 wherein said base frame positively engages said base connecting link during reclining movement of said longitudinal link to prevent further movement of said support linkage assembly during further reclining movement.

3. The reclining mechanism of claim 2 wherein said support linkage assembly further comprises a connecting link having a first end pivotally coupled to said base connecting link and a second end pivotally coupled to said intermediate link at said second pivot.

4. The reclining mechanism of claim 1 wherein said support linkage assembly further comprises a control link pivotally coupled to said base assembly at a first end and operably coupled to said drive rod at a second end.

5. The reclining mechanism of claim 4 wherein said support linkage assembly further comprises a drive link pivotally coupled to said control link at a first end and coupled to said drive rod for concurrent rotation therewith.

6. The reclining mechanism of claim 1 further comprising a swivel base assembly secured to said base frame to provide a rotational degree of freedom between said base frame and a floor upon which said reclining mechanism is supported.

7. The reclining mechanism of claim 6 further comprising:

said base frame having a pair of first side rails interconnected by a front cross member and a rear cross member, said pair of first side rails operably coupled to said support linkage assembly, and a pair of second side rails extending between said front and rear cross members;

a base member; and a swivel plate assembly secured to said pair of second side rails and operably disposed between said base frame and said base member to provide said rotational degree of freedom.

8. A reclining mechanism comprising:

a base frame;

a support linkage assembly including a front support link pivotally coupled to said base frame at a front base pivot, a rear support link pivotally coupled to said base frame at a rear base pivot, and an intermediate link pivotally coupled to said front support link at a front upper pivot and pivotally coupled to said rear support link at a rear upper pivot;

a longitudinal link operably coupled to said support linkage assembly; and a recline linkage assembly operably coupled between said longitudinal link and said base frame for controlling reclining movement of said longitudinal link from an upright position to a reclined position, said recline linkage assembly including a recline drive link pivotally coupled to said rear support link, a recline control link having a first end pivotally coupled to said recline drive link and a second end operably coupled to a swing link, said recline control link pivotally coupled to said longitudinal link intermediate said first and second ends thereof.

9. The reclining mechanism of claim 8 further comprising:

a front link axis defined by said front base pivot and said front upper pivot;

a rear link axis defined by said rear base pivot and said rear upper pivot; and a recline control link axis defined by said first and second ends thereof, said recline linkage assembly operably to position said recline control link through a range of motion during said reclining movement such that said recline control link axis remains between said front link axis and said rear link axis.

10. The reclining mechanism of claim 8 wherein said recline linkage assembly further comprises a recline connecting link having a first end pivotally coupled to said recline control link and a second end pivotally coupled to said swing link.

11. The reclining mechanism of claim 8 further comprising:

a rotatable drive rod journally supported by said longitudinal link and operably coupled thereto such that reclining movement of said longitudinal link rotates said drive rod in a first direction; and a leg rest assembly operably coupled to said longitudinal link for movement from a retracted position to an extended position in response to rotation of said drive rod in said first direction.

12. The reclining mechanism of claim 8 wherein said support linkage assembly further comprises a base connecting link pivotally coupled to said base frame at a first end and operably coupled to said intermediate link.

13. The reclining mechanism of claim 12 wherein said base frame positively engages said base connecting link during reclining movement of said longitudinal link to prevent further movement of said support linkage assembly during further reclining movement.

14. The reclining mechanism of claim 8 further comprising a swivel base assembly secured to said base frame to provide a rotational degree of freedom between said base frame and a floor upon which said reclining mechanism is supported.

15. The reclining mechanism of claim 14 further comprising:

said base frame having a pair of first side rails interconnected by a front cross member and a rear cross member, said pair of first side rails operably coupled to said support linkage assembly, and a pair of second side rails extending between said front and rear cross members;

a base member; and a swivel plate assembly secured to said pair of second side rails and operably disposed between said base frame and said base member to provide said rotational degree of freedom.

16. A reclining chair comprising:

a base frame;

a chair frame having a seat frame and a seat back;

a support linkage assembly pivotally coupled to said base frame, said support linkage assembly including a first support link pivotally coupled to said base frame, a second support link pivotally coupled to said base frame, an intermediate link pivotally coupled to said first support link at a first pivot and pivotally coupled to said second support link at a second pivot, and a base connecting link pivotally coupled to said base frame at a first end and operably coupled to said intermediate link;

a longitudinal link operably coupled to said support linkage assembly, said seat frame secured to said longitudinal link such that said support linkage assembly supports said chair frame above said base frame;

a recline linkage assembly operably coupled between said longitudinal link and said base frame for controlling reclining movement of said longitudinal link from an upright position to a reclined position, said recline linkage assembly having a swing link assembly pivotally coupling said seat back to said longitudinal link;

a rotatable drive rod journally supported by said longitudinal link and operably coupled thereto such that reclining movement of said longitudinal link rotates said drive rod in a first direction; and a leg rest assembly supported from said longitudinal link and operably coupled to said drive rod for movement from a retracted position to an extended position in response to rotation of said drive rod in said first direction.

17. The reclining chair of claim 16 wherein said swing link assembly is pivotally coupled to said longitudinal link at a recline pivot which is located forwardly of a line defined by a forward edge of said seat back.

18. The reclining chair of claim 17 wherein said recline pivot is located vertically above a line defined by an upper edge of said seat frame.

19. The reclining chair of claim 16 wherein said base frame positively engages said base connecting link during reclining movement of said longitudinal link to prevent further movement of said support linkage assembly during further reclining movement.

20. The reclining chair of claim 16 wherein said support linkage assembly further comprises a control link pivotally coupled to said base assembly at a first end and operably coupled to said drive rod at a second end.

21. The reclining chair of claim 20 wherein said support linkage assembly further comprises a drive link pivotally coupled to said control link at a first end and coupled to said drive rod for concurrent rotation therewith.

22. The reclining chair of claim 16 further comprising:

a front link axis defined by said front base pivot and said front upper pivot;

a rear link axis defined by said rear base pivot and said rear upper pivot; and a recline control link axis defined by a first end and a second end thereof, said recline linkage assembly operable to position said recline control link through a range of motion during said reclining movement such that said recline control link axis remains between said front link axis and said rear link axis.

23. The reclining chair of claim 22 wherein said recline linkage assembly further comprises a recline connecting link having a first end pivotally coupled to said recline control link and a second end pivotally coupled to said swing link.

24. The reclining chair of claim 16 further comprising a swivel base assembly secured to said base frame to provide a rotational degree of freedom between said base frame and a floor upon which said reclining chair is supported.

25. The reclining chair of claim 24 further comprising:

said base frame having a pair of first side rails interconnected by a front cross member and a rear cross member, said pair of side rails operably coupled to said support linkage assembly, and a pair of second side rails extending between said front and rear cross members;

a base member; and a swivel plate assembly secured to said pair of second side rails and operably disposed between said base frame and said base member to provide said rotational degree of freedom.

26. A reclining mechanism comprising:

a base frame;

a support linkage assembly including a first support link pivotally coupled to said base frame, a second support link pivotally coupled to said base frame, and an intermediate link pivotally coupled to said first support link at a first pivot and pivotally coupled to said second support link at a second pivot;

a longitudinal link operably coupled to said support linkage assembly;

a recline linkage assembly operably coupled between said longitudinal link and said base frame for controlling reclining movement of said longitudinal link from an upright position to a reclined position; and an adjustable drive spring assembly operably disposed between said base frame and said support linkage assembly to forwardly bias said support linkage assembly for assisting movement of said longitudinal link from said upright position to said reclined position.

27. The reclining mechanism of claim 26 wherein said adjustable drive spring assembly comprises a spring having a first end connected to said base frame and a second end operably coupled to said second support link and tension adjusting means for adjusting the tension in said spring.

28. The reclining mechanism of claim 27 wherein said tension adjusting means comprises an adjustable length bracket having a first end connected to said second end of said spring and a second end coupled to said second support link.

29. The reclining mechanism of claim 28 wherein said adjustable length bracket is an elongated member having a first end with an aperture formed therethrough to receive said second end of said spring and a second end with a plurality of apertures formed therethrough for receiving a retaining pin, said second end of said adjustable length bracket received in a slot formed in a member of said support linkage assembly such that said plurality of apertures and said receiving pin provide adjustment for the length of said adjustable length bracket.

30. A reclining mechanism comprising:

a base frame;

a support linkage assembly including a first support link pivotally coupled to said base frame, a second support link pivotally coupled to said base frame, and an intermediate link pivotally coupled to said first support link at a first pivot and pivotally coupled to said second support link at a second pivot;

a longitudinal link operably coupled to said support linkage assembly; and a recline linkage assembly operably coupled between said longitudinal link and said base frame for controlling reclining movement of said longitudinal link from an upright position to a reclined position, said recline linkage assembly having an adjustable seat slide for adjusting a friction force generated at said first pivot during movement of said longitudinal link from said upright position to said reclined position.

31. The reclining mechanism of claim 30 wherein said adjustable seat slide comprises a lost motion slot formed in said longitudinal link and a threaded slide pin extending through said lost motion slot and pivotally coupling said first support link to said intermediate link at said first pivot, said threaded slide pin having a threaded fastener disposed on an end thereof and a tensioning spring disposed over said threaded fastener between said longitudinal link and said threaded fastener such that said threaded fastener is positionable to adjust the friction generated at said first pivot.

32. The reclining mechanism of claim 31 wherein said adjustable seat slide further comprises at least one friction washer disposed on a side of said longitudinal link.

33. The reclining mechanism of claim 32 wherein said adjustable seat slide further comprises a nylon insert disposed in said lost motion slot.

34. A reclining mechanism comprising:

a base frame;

a support linkage assembly including a first support link pivotally coupled to said base frame, a second support link pivotally coupled to said base frame, and an intermediate link pivotally coupled to said first support link at a first pivot and pivotally coupled to said second support link at a second pivot;

a longitudinal link operably coupled to said support linkage assembly;

a recline linkage assembly operably coupled between said longitudinal link and said base frame for controlling reclining movement of said longitudinal link from an upright position to a reclined position;

a rotatable drive rod journally supported by said longitudinal link and operably coupled thereto such that reclining movement of said longitudinal link rotates said drive rod in a first direction; and a spring assist drive linkage including a spring operably coupled between said drive rod and said base frame for forwardly biasing said support linkage and for rotationally biasing said drive rod.

35. The reclining mechanism of claim 34 wherein said spring assist drive linkage further comprises an over-center linkage interdisposed between said drive rod and said spring for alternating the rotational biasing of said drive rod by said spring depending upon the position of said over-center linkage.

36. The reclining mechanism of claim 35 wherein said over-center linkage comprises a drive link secured to said drive rod for rotation therewith and an over-center connecting link interdisposed between said drive link and said spring.

37. The reclining mechanism of claim 34 further comprising a leg rest assembly operably coupled to said longitudinal link for movement from a retracted position to an extended position in response to rotation of said drive rod in said first direction.

38. A reclining chair comprising:

a base frame;

a chair frame;

a support linkage assembly including a first support link pivotally coupled to said base frame, a second support link pivotally coupled to said base frame, and an intermediate link pivotally coupled to said first support link at a first pivot and pivotally coupled to said second support link at a second pivot, said chair frame secured to said longitudinal link such that said support linkage assembly supports said chair frame above said base frame;

a longitudinal link operably coupled to said support linkage assembly;

a recline linkage assembly operably coupled between said longitudinal link and said base frame for controlling reclining movement of said longitudinal link from an upright position to a reclined position;

a rotatable drive rod journally supported by said longitudinal link and operably coupled thereto such that reclining movement of said longitudinal link rotates said drive rod in a first direction; and a cable release assembly for initiating said reclining movement of said longitudinal link, said cable release assembly including a release handle mounted to said chair frame and a trip link assembly operably coupled to said cable release via a release cable.

39. The reclining mechanism of claim 38 wherein said trip link assembly comprises:

a drive link secured to said drive rod for rotation therewith, said drive link having a cam surface formed thereon; and a trip link pivotally coupled to said longitudinal link and having a pin extending therefrom such that manipulation of said release handle rotates said trip link so that said pin engages said cam surface to rotate said drive link, thereby rotating said drive rod to initiate reclining movement of said longitudinal link.

40. The reclining mechanism of claim 39 further comprising an over-center linkage operably coupled to said drive rod and positionable between a first position wherein said over-center linkage rotational biases of said drive rod in a first direction and a second position wherein said over-center linkage rotational biases of said drive rod in a second direction, said trip link operable to position said over-center linkage from said first position to said second position.

41. The reclining mechanism of claim 39 wherein said cam surface is a sloped surface for providing a mechanical advantage to said trip link, thereby providing a mechanical advantage when initiating said reclining movement.

42. The reclining mechanism of claim 38 further comprising a leg rest assembly operably coupled to said drive link for movement from a retracted position to an extended position in response to rotation of said drive rod in said first direction.

* * * * *